US007231896B2

(12) United States Patent
Mott et al.

(10) Patent No.: US 7,231,896 B2
(45) Date of Patent: Jun. 19, 2007

(54) CONTROL MECHANISM FOR CAM PHASER

(75) Inventors: Philip J. Mott, Dryden, NY (US); Andrew Mott, Dryden, NY (US); Zhenyu Jiang, Jersey City, NJ (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/459,123

(22) Filed: Jul. 21, 2006

(65) Prior Publication Data

US 2007/0017463 A1 Jan. 25, 2007

Related U.S. Application Data

(63) Continuation-in-part of application No. 10/959,736, filed on Oct. 6, 2004, now abandoned.

(60) Provisional application No. 60/701,265, filed on Jul. 21, 2005, provisional application No. 60/510,373, filed on Oct. 10, 2003.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 5,002,023 | A | 3/1991 | Butterfield et al. | |
| 5,107,804 | A | 4/1992 | Becker et al. | |
| 5,172,659 | A | 12/1992 | Butterfield et al. | |
| 5,184,578 | A | 2/1993 | Quinn, Jr. et al. | |
| 5,289,805 | A | 3/1994 | Quinn, Jr. et al. | |
| 5,361,735 | A | 11/1994 | Butterfield et al. | |
| 5,497,738 | A | 3/1996 | Siemon et al. | |
| 5,507,254 | A | 4/1996 | Melchior | |
| 5,645,017 | A | 7/1997 | Melchior | |
| 5,649,506 | A | 7/1997 | Melchior | |
| 5,657,725 | A | 8/1997 | Butterfield et al. | |
| 6,247,434 | B1 | 6/2001 | Simpson et al. | |
| 6,250,265 | B1 | 6/2001 | Simpson | |
| 6,263,846 | B1 | 7/2001 | Simpson et al. | |
| 6,311,655 | B1 | 11/2001 | Simpson et al. | |
| 6,374,787 | B2 | 4/2002 | Simpson et al. | |
| 6,477,999 | B1 | 11/2002 | Markley | |
| 6,481,402 | B1 * | 11/2002 | Simpson et al. | 123/90.17 |
| 6,796,276 | B2 | 9/2004 | Kim | |
| 6,814,038 | B2 | 11/2004 | Smith | |

FOREIGN PATENT DOCUMENTS

| | | |
|---|---|---|
| JP | 07224621 | 8/1995 |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A VCT phaser having a mechanical feedback in which no elaborate sensors and its concomitant electronic control loop is required. The phaser has center mounted spool valve controlling the flow of control fluid such that when a command positions the same at a predetermined position, passages within the phaser adjusts to a desired position through the mechanical feedback.

10 Claims, 28 Drawing Sheets

10

CONTROL MECHANISM FOR CAM PHASER

REFERENCE TO RELATED APPLICATIONS

This application is a continuation-in-part of application Ser. No. 10/959,736, filed Oct. 6, 2004, entitled "CONTROL MECHANISM FOR CAM PHASER", which claimed an invention disclosed in provisional application No. 60/510,373, filed Oct. 10, 2003, entitled, "CONTROL MECHANISM FOR CAM PHASER," now abandoned.

This application also claims an invention which was disclosed in Provisional Application No. 60/701,265 filed Jul. 21, 2005, entitled "SERVO STYLE VARIABLE CAM TIMING PHASER". The benefit under 35 USC §119(e) of the U.S. provisional application is hereby claimed, and the aforementioned applications are hereby incorporated herein by reference.

FIELD OF THE INVENTION

The invention pertains to the field of variable cam timing systems. More particularly, the invention pertains to variable cam timing systems with a control mechanism including a valve with helical slots.

BACKGROUND OF THE INVENTION

The performance of an internal combustion engine may be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts may be driven by a single crankshaft powered chain drive or belt drive. Engine performance in an engine with dual camshafts may be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end, which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control method suitable for computer implementation that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft and is oscillatable with respect to the camshaft. The vane has opposed lobes which are received in opposed recesses, respectively, of the pulley. The camshaft tends to change in reaction to torque pulses, which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which, is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes a camshaft that has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending there through. The passage extends parallel to and is spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there is sufficient pressure within the pocket to keep the free end of the pin from entering the pocket. At low levels of hydraulic pressure, however, the free end of the pin enters the pocket and latches the camshaft and the sprocket together in a predetermined orientation.

In addition, it is known to have an electronic feedback loop involving sensors sensing the positions of shafts such as camshaft or crankshaft in a VCT system. For example, pulse wheels are rigidly affixed onto the shafts for the sensors sensing purposes. The sensed pulses are in turn processed into information wherein derived positional information of a rotor or vane in relation to a housing is used to control a control valve (spool) which in turn is used to control a phase relationship. Typically, the spool valve comprises two lands thereon for stopping fluid communications as desired.

In Melchior's U.S. Pat. No. 5,645,017, U.S. Pat. No. 5,649,506, and U.S. Pat. No. 5,507,254, a rotary cylinder is connected to and rotates with a drive shaft by means of a gear pinion. A piston having a vane is connected to the driven shaft. One-way communication circuits are provided in the rotary piston, with check valves carried in the vane. The shaft of the piston is hollow and carries a slidable slide that rotates in synchronism with the driving shaft. The slide includes two external recesses that are separated by an axially extending rib that is helical in shape. The unidirectional circuits include a common section with an end leading to an orifice, which depending on the position of the slide is open to the recesses or closed by the axially extending valve rib. When the slide is in the null position, the fluid cannot move between the chambers, in the chambers or out of the chambers. When some leakage has occurred, causing an undesirably or uncontrolled phase shift, the orifice is uncovered or no longer blocked by the axially extending valve rib, allowing a direct one-way fluid flow passage from a first chamber to a second chamber through a check valve to a common passage, through a recess and back to the other passage leading to the second chamber. The shift in fluid from the first chamber to the second chamber causes the piston and axially extending valve rib to rotate relative to the cylinder until the orifice of the common passage is completely obstructed by the axially extending valve rib.

While advancing and retarding of the phase coupling are described as leakage between the chambers, eventually the remaining fluid in the phase coupling will be inadequate to alter the timing between the drive shaft and the driven shaft, due to leakage of the phase coupling as a whole, since a makeup line is not disclosed. The leakage cannot be fixed by moving fluid from one chamber to the other and vice versa, causing the chambers to have an inadequate amount of fluid to properly alter the phase between the drive shaft and the driven shaft.

Melchior cannot provide a makeup source to the chambers. Due to the position of the common passage/orifice and the positioning of the axially extending valve rib, makeup fluid cannot enter the chambers when the phase coupling is in the null position or in other positions based on the unidirectional circuits.

Since the phase coupling in Melchior's U.S. Pat. No. 5,645,017, U.S. Pat. No. 5,649,506, and U.S. Pat. No. 5,507,254 cannot be supplied with makeup oil from a supply due to the axially extending valve rib, the axially extending valve rib cannot be used with phasers that require a constant or semi-constant source of oil pressure to operate, such as a torsion assist phaser, an oil pressure actuated phaser, or a hybrid phaser disclosed infra. In an oil pressure actuated or a torsion assist phaser, the main force in moving the vanes is engine oil pressure, with fluid being supplied to a first chamber and simultaneously exhausted from the other chamber to sump. A constant source of pressurized fluid is required in order to actuate the phaser, and thus alternate the phase. In a hybrid phaser, cam torque is used in conjunction with an oil pressure to actuate the phaser and alter the phase. The oil pressure portion of the phaser is used when the cam torque is not large enough or will not be sufficient to alter the phase. Melchior also discloses a stepped shaped rib with similar problems as described above.

SUMMARY OF THE INVENTION

A VCT phaser having a mechanical feedback in which no elaborate sensors and concomitant electronic control loop is required. The phaser has a center mounted spool valve controlling the flow of control fluid such that when a command positions the same at a predetermined position, passages within the phaser adjust to a desired position through the mechanical feedback.

DESCRIPTION OF THE PREFERRED EMBODIMENT

Figure 1:
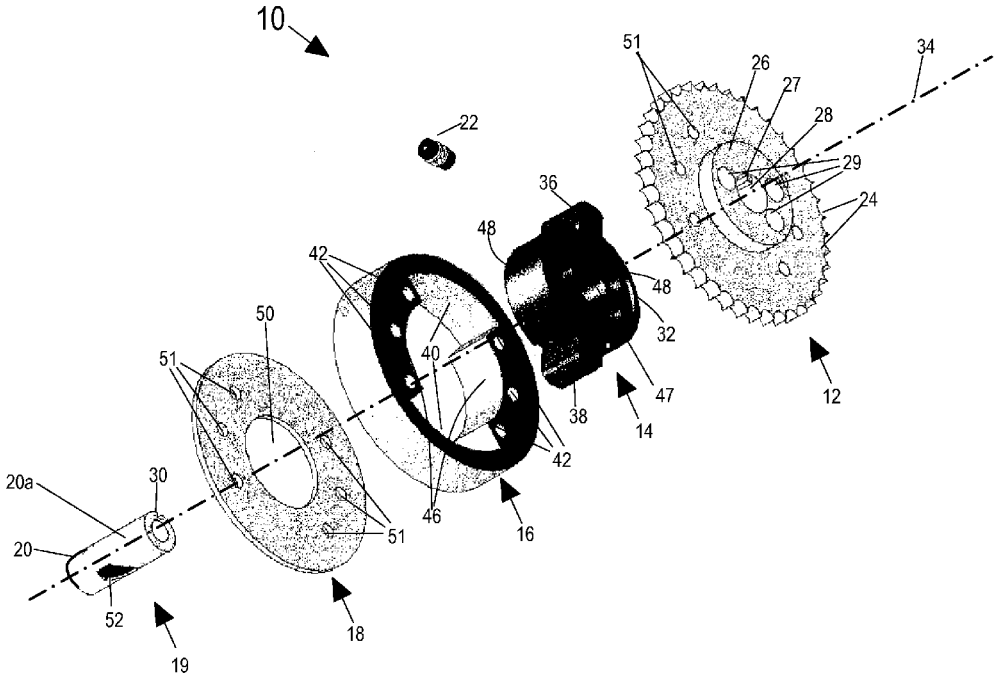
FIG. 1 shows an exploded view of a phaser assembly of the present invention.

Referring to FIGS. 1 through 4, a phaser 10, preferably a cam torque actuated phaser, of a first embodiment is mounted on one end of a camshaft (not shown) with a rotor 14 rigidly affixed onto one end. A control valve 19, preferably a spool valve is coupled to a sprocket 12, which is coupled to a crankshaft by means of a timing chain (not shown). Angular adjustment may be achieved by relative movement of the sprocket 12 in relation to rotor 14. According to the present invention, the angular adjustment is accomplished by moving control valve 19 translationally along axis 34 relatively to the other members of phaser 10. By positioning spool valve 19 at a plurality of predetermined positions along axis 34, mechanical feedback or self-adjustment mechanism (details shown infra) adjusts the angular relationship between the sprocket 12 and the rotor 14 and thus the camshaft and the crankshaft.

Figure 2:
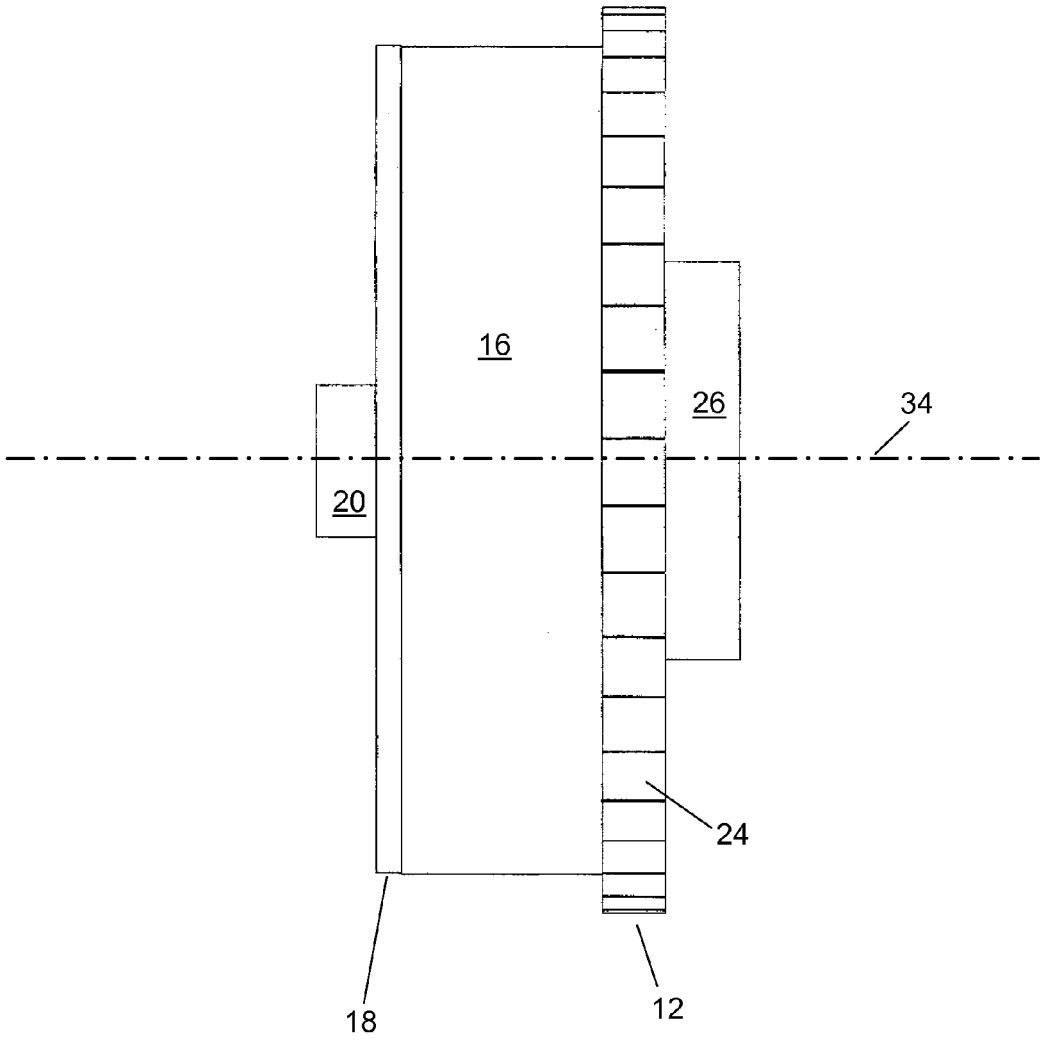
FIG. 2 shows a side view of the phaser of the present invention.

FIG. 2 shows a side view of the assembled phaser 10 of a first embodiment of the present invention. A housing 16 is fixedly attached to a sprocket 12 having an outer circumference of teeth 24 for accepting drive force. A back plate 18 is mounted to the opposite side of the housing 16. A central bore, shown in FIG. 1, is present along axis 34 and slidably receives a spool valve 19. The spool 20 of the spool valve 19 translationally moves along axis 34.

Figure 3:
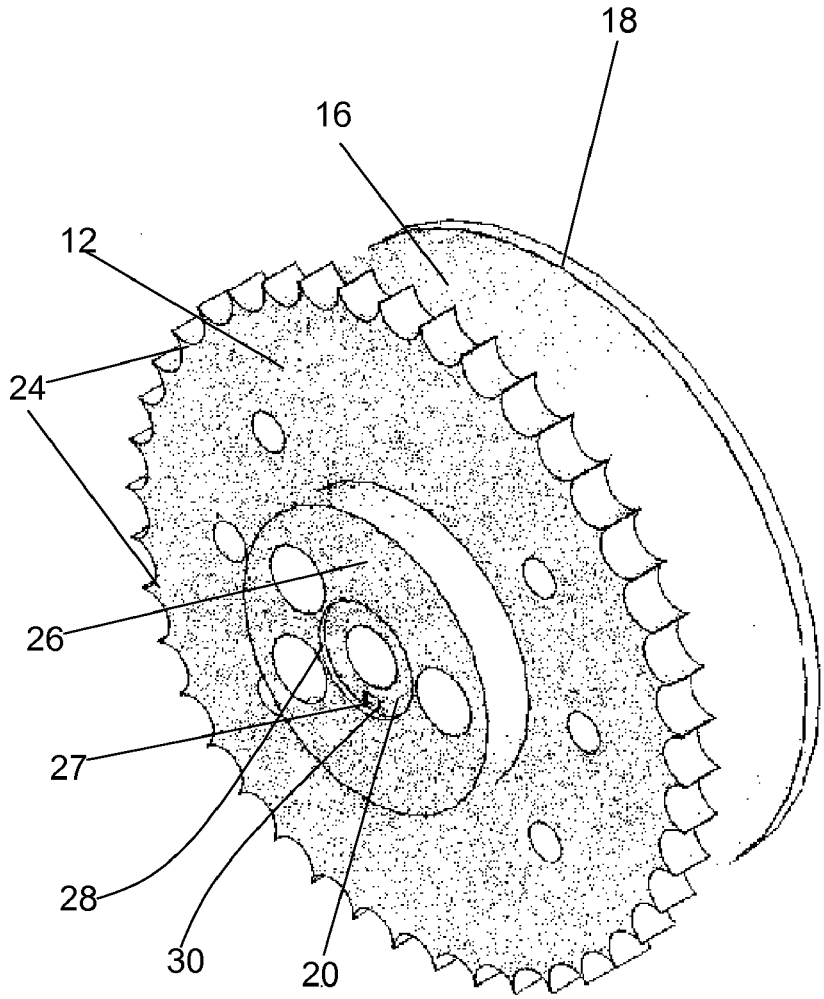
FIG. 3 shows a perspective view of the phaser of the present invention.

Referring to FIGS. 1 and 3, phaser 10 includes a housing 16 for receiving a rotor 14. The housing 16 is attached to a back plate 18 and sprocket 12. Sprocket 12 has teeth 24 on its outer circumference for accepting drive force and a central inner portion 26 that is substantially cylindrical shaped. The central inner portion 26 has a center opening 28 for accommodating control valve 19, preferably a spool valve. Sprocket 12 also has a key 27 of an elongated shape that protrudes from the central inner portion 26 into center opening 28 for slidably engaging and being received by a notch 30 formed axially on the outer circumference of spool 20. Sprocket 12 further includes a set of inner openings 29, of which only three are shown, on the central inner portion 26 of the sprocket 12 for accommodating the maintenance of coupling elements to affix the rotor 14 onto a third member such as a camshaft (not shown). Sprocket 12 also has a set of outer openings 51, of which only six are shown for affixing the same onto the housing 16 and the back plate 18. A check valve 22 is also provided.

Rotor 14 has a bore 47 centrally located and aligned with the center opening 28 of the sprocket 12, to allow for the axial movement of spool 20 along an axis 34. Furthermore, rotor 14 can rotate in relation to spool 20. Rotor 14 further comprises a first vane 36 and a second vane 38 with the first vane 36 being diametrically opposite from the second vane 38. The second vane 38 has an opening therein disposed for receiving at least one check valve 22.

The housing 16 encloses the rotor 14, forming a pair of cavities 40. The cavities 40 are further divided into advance and retard chambers by the first vane 36 and the second vane 38, which oscillate therein. The housing 16 has a set of openings 42 identical in numbers as that of outer openings 51 on the back plate 18. Housing 16 further has an inner bearing surface 46 for rotatably coupling with an outer surface 48 of rotor 14.

Back plate 18 has a center opening 50 having a diameter that is less than the diameter 48 of rotor 14 for contributing to the closure of a set of passages 86, 88 for fluid communication between advance and retard chambers defined within cavities 40 and delimited by first vane 36 or the second vane 38. In other words, part of the back plate 18, along with portions of the rotor 14 form passages 86, 88, seen in FIGS. 5*a* and 6*a*. Back plate 18 further has a set of openings 51 having identical numbers as that of opening 42 or outer openings 51.

The control valve 19, preferably the spool valve comprises a pair of helical slots 52 (only one shown) on an outer circumference 20*a* of a spool 20, which function as a conduit and serve to regulate the flow to the advance and retard chambers. "Slot" being defined as a passage or opening recessed into the outside circumference of the spool. The control valve may be positioned by an actuator (not shown). Key 27 of inner portion 26 is received by or mates with notch 30 of spool 20, with spool 20 located within center bore 28 of inner portion 26. Through the mating of key 27 and the notch 30, sprocket 12 and spool 20 engage each other and rotate in unison together forming a predetermined angular relationship between the sprocket 12 and the spool 20. Therefore, spool 20 rotates in unison with sprocket 12, yet spool 20 can still translationally slide along axis 34. As shown earlier, rotor 14 has an inner bearing surface 46 in which the spool 20 rotates.

Figure 4:
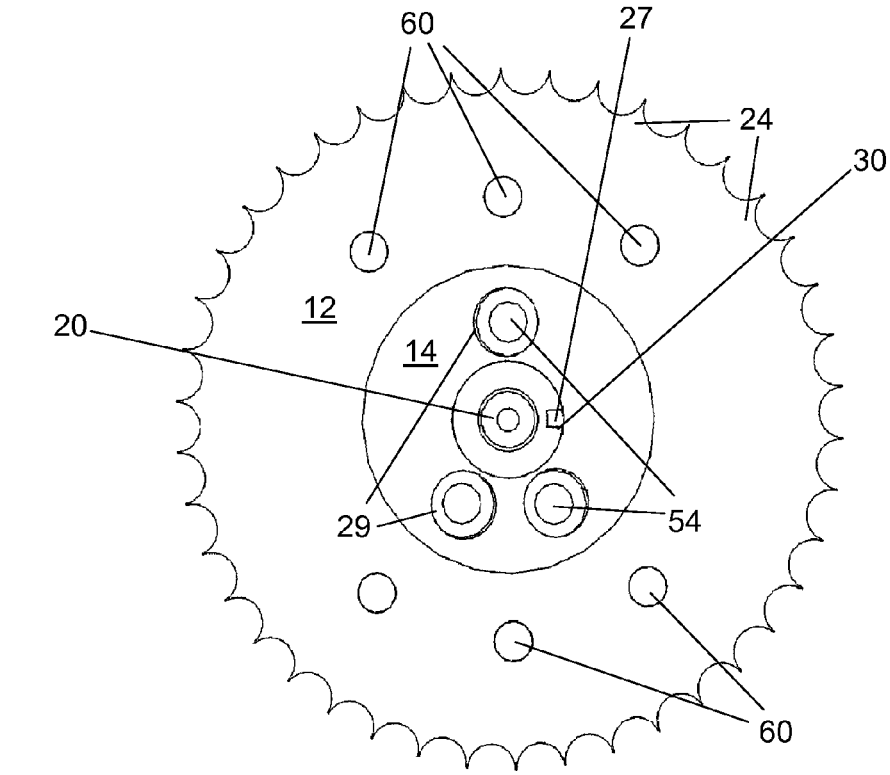
FIG. 4 shows a front view of the phaser of the present invention.

Referring specifically to FIG. 4, an elevated perspective view of phaser 10 is shown. Note the inner openings 29 facilitate the three bolts 54 going through rotor 14. It is noted that FIG. 4 merely shows a special case of the angular relationship between sprocket 12 and rotor 14, in which inner openings 29 of sprocket 12 happens to permit a top view of bolts 54. Bolts 54 are not affixed onto sprocket 12, but instead bolts 54 are affixed onto rotor 14 which rotates relative to sprocket 12. Therefore, at other angular relationships, bolts 54 may only be partially shown or not shown at all. Further, the present figure shows another view of key 27 of sprocket 12 disposed to engage and rotate with spool 20 by way of key 27 engaging notch 30 of spool 20. In addition, opening 60 may be used to rigidly affix sprocket 12 onto housing 16.

Figure 5A:
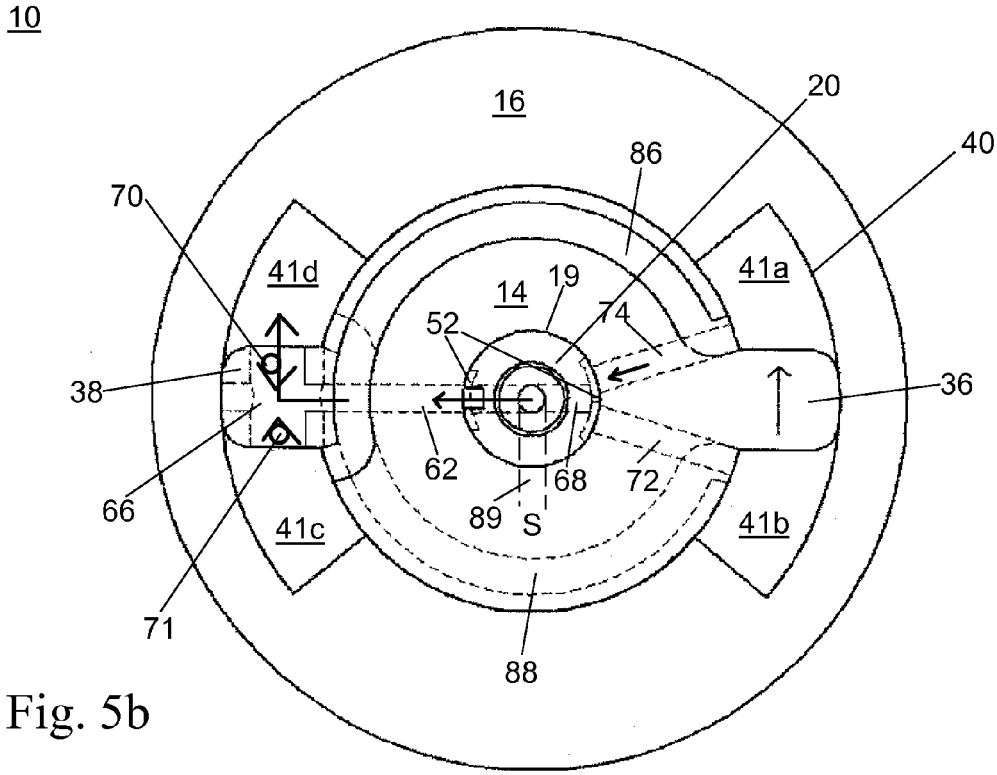
FIG. 5*a* shows an exemplified phaser of the present invention moving towards a retard position.
Figure 5B:
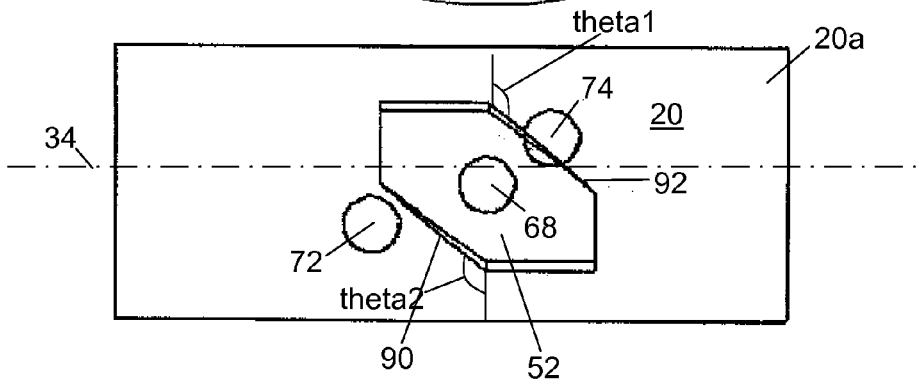
FIG. 5*b* shows the shape or formation of helical slot in the spool valve in the retard position.
Figure 6C:
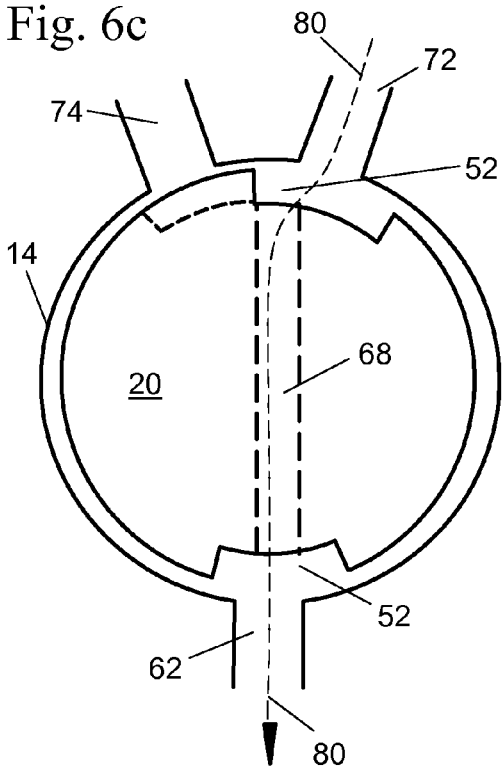
FIG. 6*c* shows a cross-sectional view of the relationship of the spool valve to the passages leading to the chambers.
Figure 5C:
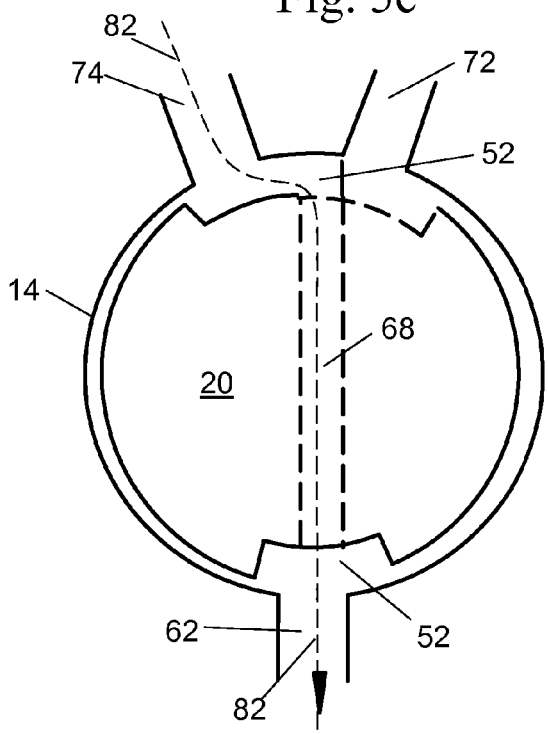
FIG. 5*c* shows a cross-sectional view of the relationship of the spool valve to the passages leading to the chambers.

FIGS. 5*a* through 6*c* show schematics of a cam torque actuated (CTA) phaser of a first embodiment of the present invention. FIGS. 5*a* and 6*a* show a schematic of the CTA phaser of the first embodiment moving towards a retard position and an advance position respectively. FIGS. 5*b* and 6*b* show the positioning of the helical slot 52 of the spool in relation to the passages 72, 74, and 68. FIGS. 5*c* and 6*c*, showing an enlarged view of the rotor 14 in relation to the chambers 41*a*, 41*b*, 41*c*, 41*d* and the paths fluid takes to and from the chambers.

Torque reversals in the camshaft caused by the forces of opening and closing engine valves move the vanes 36, 38. The advance and retard chambers 41*a*, 41*b*, 41*c*, 41*d* are arranged to resist positive and negative torque pulses in the camshaft (not shown) and are alternatively pressurized by the cam torque. The spool valve 19 in the cam torque actuated system allows the vanes 36, 38 in the phaser to move, by permitting fluid flow from the advance chamber 41*a*,41*c* to the retard chamber 41*b*, 41*d* or vice versa, depending on the desired direction of movement.

Cavities 40 formed between the housing 16 and the rotor 14 are each subdivided into first and second advance chambers 41*a*, 41*c* and first and second retard chambers 41*b*, 41*d* by a first vane 36 and a second vane 38. The first advance chamber 41*a* is in fluid communication with the second advance chamber 41*c* through passage 86 and the first retard chamber 41*b* is in fluid communication with the second retard chamber 41*d* through passage 88. A common passage 62 formed within rotor 14 extends to the second vane 38 with a first end always in fluid communication with a passage 68 in spool 20 via helical slot 52 and a second end ending in a passage 66 in the second vane 38. "Slot" being defined as a passage or opening recessed into the outside circumference of the spool. A pair of check valves 70, 71 in passage 66 is provided to selectively permit control fluid to flow either to the second advance chamber 41*c*, or the second retard chamber 41*d*.

The first retard chamber 41*b* is also selectively coupled to the second advance chamber 41*c* through passages 72, 68, 62, 66 in which at least one of the passages is controlled by helical slot 52 of the spool 20. Passage 72 connects the first retard chamber 41*b* to the spool 20 and the helical slot 52. Similarly, the first advance chamber 41*a* is selectively coupled to the second retard chamber 41*d* through passages 74, 68, 62, 66 in which at least one of the passages is controlled by helical slot 52 of the spool 20. Passage 74 connects the first advance chamber 41*a* to the spool 20 and helical slot 52.

Figure 6A:
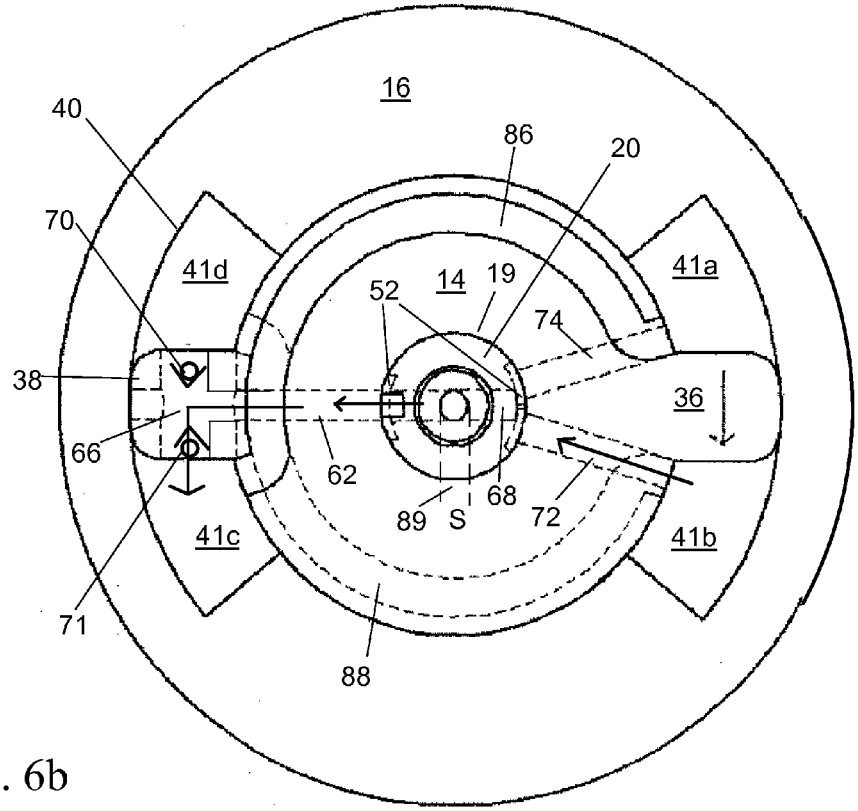
FIG. 6*a* shows an exemplified phaser of the present invention moving towards the advance position.
Figure 6B:
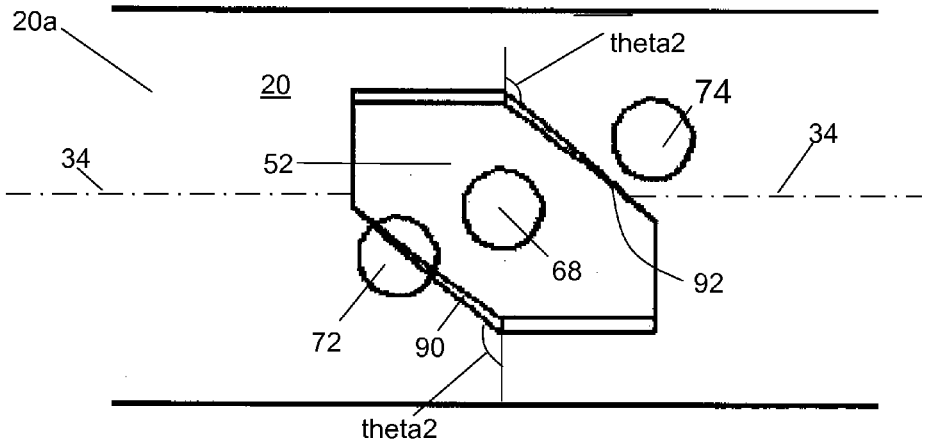
FIG. 6*b* shows the shape or formation of helical slot in the advance position.
Figure 10:
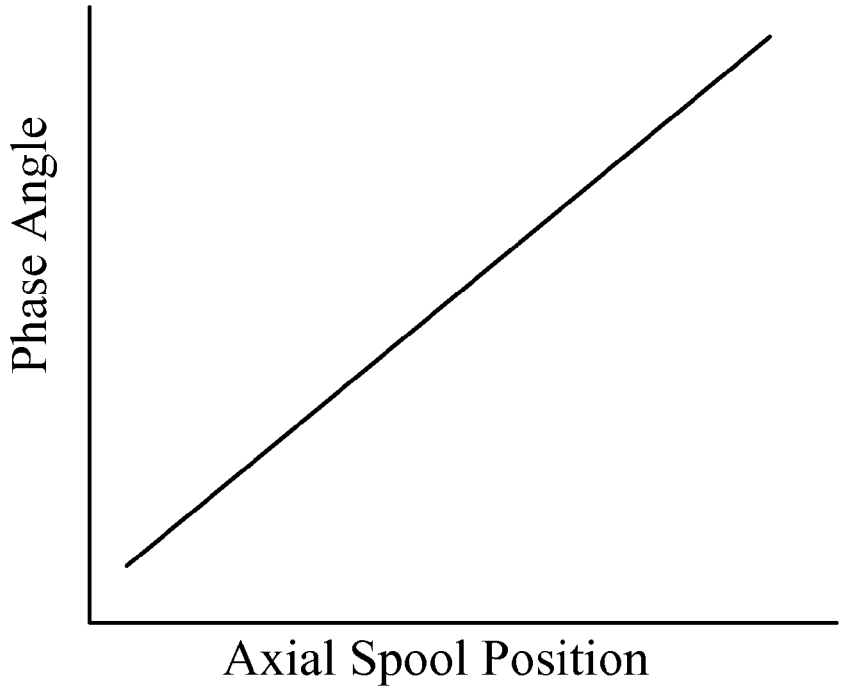
FIG. 10 shows a graph of phase angle versus axial spool position.

The helical slot 52 of the spool 20 is formed such that as the spool 20 moves translationally along axis 34, the edges of the helical slot 20 may block the passage 74 or passage 72, as shown in FIGS. 5*a* and 6*a*. Helical slot 52 is a hollowed out portion or region of spool 20 thereon its outer surface circumference 20*a*. Helical slot 52 has six edges. Two of the six edges, specifically longer edges 90 and 92 have a pair of non-zero angles in relation to the generally symmetrical shape of spool 20. In other words, angle $\theta_1$ and angle $\theta_2$ are of a non-zero value. Further, edges 90 and 92 are of a sufficient length to be at least longer than the diameter of passage 72 or passage 74 respectively. When spool 20 moves translationally back and forth along axis 34, either passages 68 and 74, or passages 68 and 72 are permitted to communicate. Therefore, fluid from either retard chamber 41*b*, 41*d* flows toward advance chamber 41*a*, 41*c* or vice versa. The result is that rotor 14 rotates in relation to housing 16. As shown in FIG. 10, the axial position of the spool 20 directly determines the angle or phase of the rotation between rotor 14 and housing 16.

Unlike passage 68 which is part of or formed within spool 20, passage 72 and passage 74 are not part of spool 20 but a part of rotor. A supply line 89 is in fluid communication with line 68, providing the necessary makeup oil to the chambers 41*a*, 41*b*, 41*c*, 41*d*.

In moving towards the retard position of the phaser, as shown in FIG. 5*a*, the spool 20 having an outer circumference 20*a* with at least one helical slot 52 is received in a bore in the rotor 14 with a biasing spring (not shown). An actuator (not shown), which may be controlled by an ECU, moves the spool 20 within the rotor 14. In moving towards the retard position, the force of the actuator was reduced and the spool 20 was moved by the spring, until the force of the spring balanced the force of the actuator. In the position shown, the outer circumference 20*a* without slot 52 blocks line 72, and lines 68 and 74 are open. Camshaft torque pressurizes the first and second advance chambers 41*a*, 41*c*, causing fluid in the advance chambers 41*a*, 41*c* to move into the retard chambers 41*b*, 41*d*. When the first advance chamber 41*a* is pressurized and selected to be in fluid communication with second retard chamber 41*d* through passages 74, 68, 62, controlled by helical slot 52 of spool 20, a first control fluid path 82 is formed (shown in FIG. 5*c*), and the first vane 36 and the second vane 38 are retarded, forcing fluid out of the first advance chamber 41*a* and into passage 74 leading to the spool 20. From passage 74, fluid flows through helical passage 52 and passage 68 to common passage 62, leading to passage 66 and through check valve 70 and into the second retard chamber 41*d*. Fluid from the second retard chamber 41*d* may flow through passage 86 to the first retard chamber 41*b* and vice versa. Fluid from the second advance chamber 41*c* exits the chamber through line 86 connected to the first advance chamber 41*a*. The first retard chamber 41*b* is not in fluid communication with the second advance chamber 41*c*. Fluid is prevented from flowing out of the first retard chamber 41*b* and through passage 72 to the spool 20 by the outer circumference 20*a* without slot 52.

Makeup oil is supplied to the phaser from supply S to make up for leakage and enters line 89 to the spool valve 19. An inlet check valve (not shown) may be present in the line 89. From the helical slot 52 in the spool valve 19 fluid enters line 68 and 62 and then passage 66 and through either of the check valves 70, 71, to the advance chambers and/or the retard chambers 41*a*, 41*b*, 41*c*, 41*d*.

In moving towards the advance position of the phaser, as shown in FIG. 6*a*, the spool 20 having an outer circumference 20*a* with at least one helical slot 52 is received in a bore in the rotor with a biasing spring (not shown). An actuator (not shown), which may be controlled by an ECU, moves the spool 20 within the rotor 14. In moving towards the advance position, the force of the actuator was greater than the force of a spring on the opposite side of the spool valve 19, and the spool 20 was moved by the actuator, until the force of the spring balanced the force of the actuator. In the position shown, the outer circumference 20*a* without slot 52 of the spool blocks line 74, and lines 68 and 72 are open. Camshaft torque pressurizes the first and second retard chambers 41*b*, 41*d*, causing fluid in the retard chambers 41*b*, 41*d* to move into the advance chambers 41*a*, 41*c*. When the first retard chamber 41*b* is selected to be in fluid communication with second advance chamber 41*c* through passages 72, 68, 62, controlled by helical slot 52 of spool 20, a second control fluid path 80 is formed (shown in FIG. 6*c*), and the first vane 36 and the second vane 38 are advanced, forcing fluid out of the first retard chamber 41*b* and into passage 72 leading to the spool 20. From passage 72, fluid flows through helical passage 52 through passage 68 to common passage 62, leading to passage 66 and through check valve 71 and into the second advance chamber 41*c*. Fluid from the second advance chamber 41*c* may flow through passage 86 to the first advance chamber 41*a* and vice versa. Fluid from the second retard chamber 41*d* exits the chamber through line 88 connected to the first retard chamber 41*b*. The first advance chamber 41*a* is not in fluid communication with the second retard chamber 41*d*. Fluid is prevented from flowing out of the first advance chamber 41*a* and through passage 74 to the spool by the outer circumference 20*a* without slot 52.

Makeup oil is supplied to the phaser from supply S to make up for leakage and enters line 89 to the spool valve 19. An inlet check valve (not shown) may be present in the line 89. From the helical slot 52 in the spool valve 19 fluid enters lines 68 and 62 and then passage 66 and through either of the check valves 70, 71, to the advance chambers and/or the retard chambers 41*a*, 41*b*, 41*c*, 41*d*.

The cam torque actuated phaser of the first embodiment provides makeup oil to the chambers through a helical slot 52 in the spool valve 19 that is always open to at least one advance chamber 41*a*, 41*c* and one retard chamber 41*b*, 41*d*, through common passage 66 with check valves 70, 71 connected to passages 68 and 62 in fluid communication with supply line 89, allowing fluid to be replenished to the system as necessary due to leakage. Without makeup oil, the phaser would eventually have little or no fluid, preventing adequate control of the phase between the camshaft and the crankshaft or driving and driven members. An inadequate amount of fluid in the phaser may also cause the vanes 36, 38 to slam into the walls of the chambers, creating excessive noise.

Figure 7A:
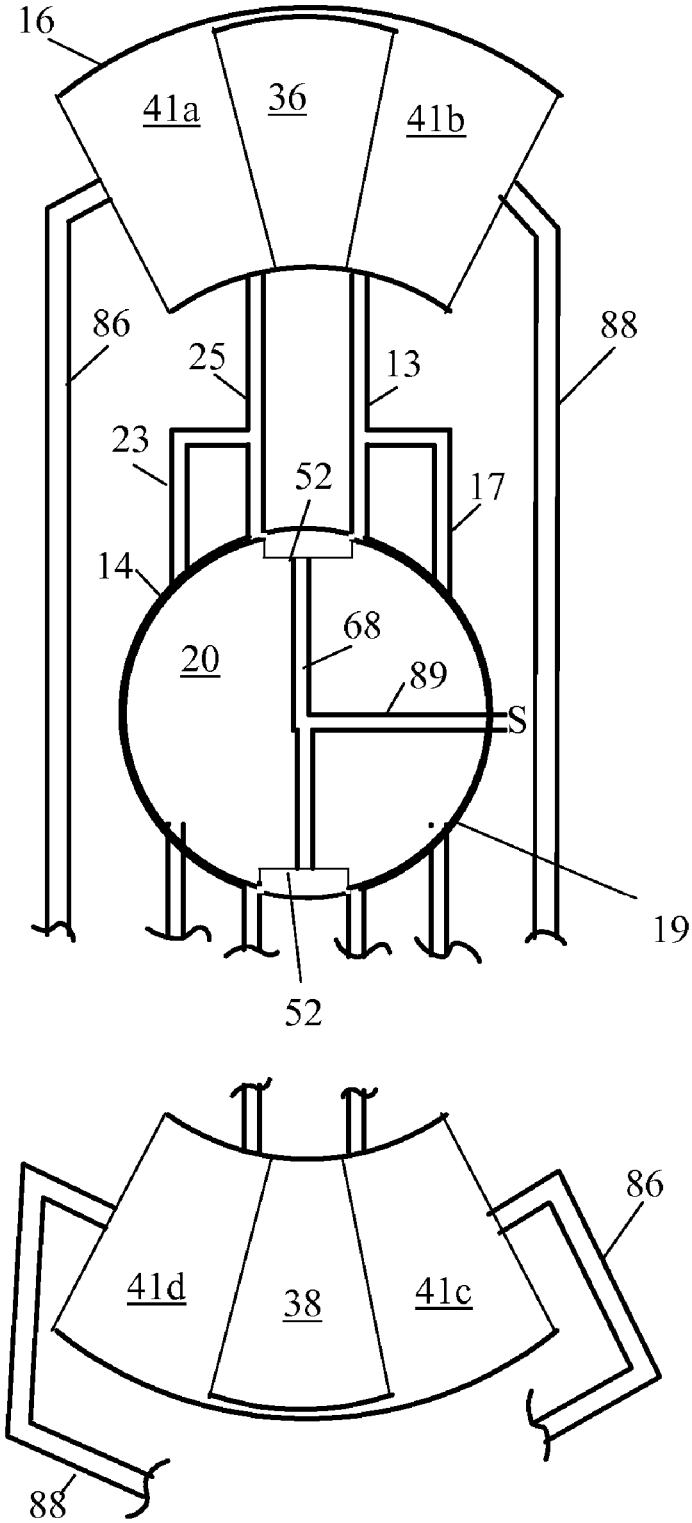
FIG. 7*a* shows a schematic of an oil pressure actuated phaser of a second embodiment in an equilibrium position.
Figure 7B:
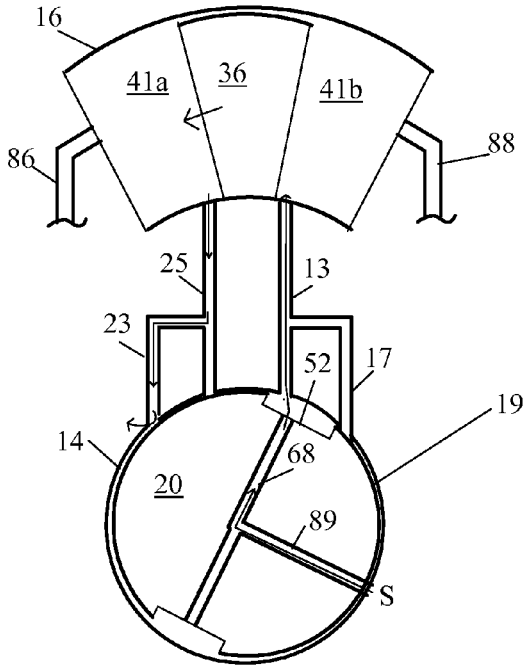
FIG. 7*b* shows a schematic of the relationship of the spool valve to the passages leading to the chambers when the oil pressure actuated phaser is moving towards a retard position.
Figure 7C:
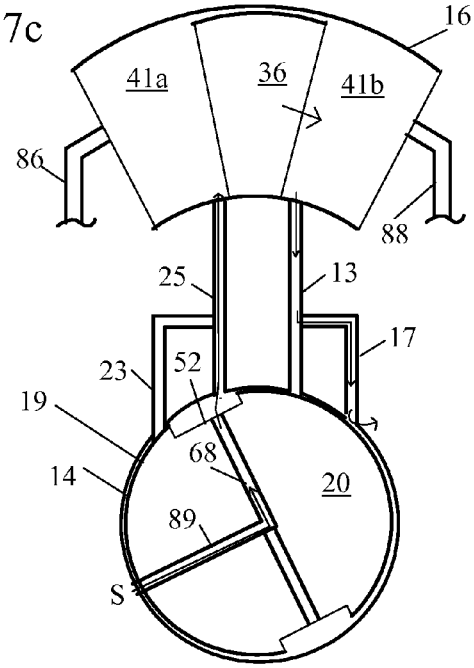
FIG. 7*c* shows a schematic of the relationship of the spool valve to the passages leading to the chambers when the oil pressure actuated phaser is moving towards an advance position.
Figure 8A:
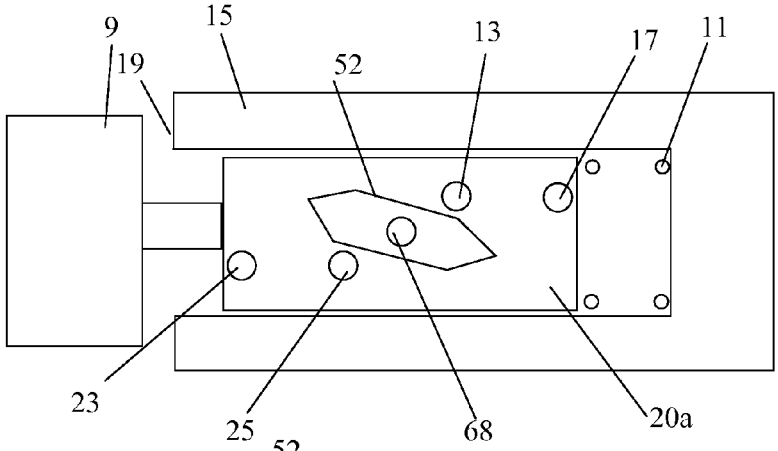
FIG. 8*a* shows the position of the spool valve and the helical slot relative to the passages leading to the chambers in an equilibrium position shown of the phaser shown in FIG. 7*a*.
Figure 8B:
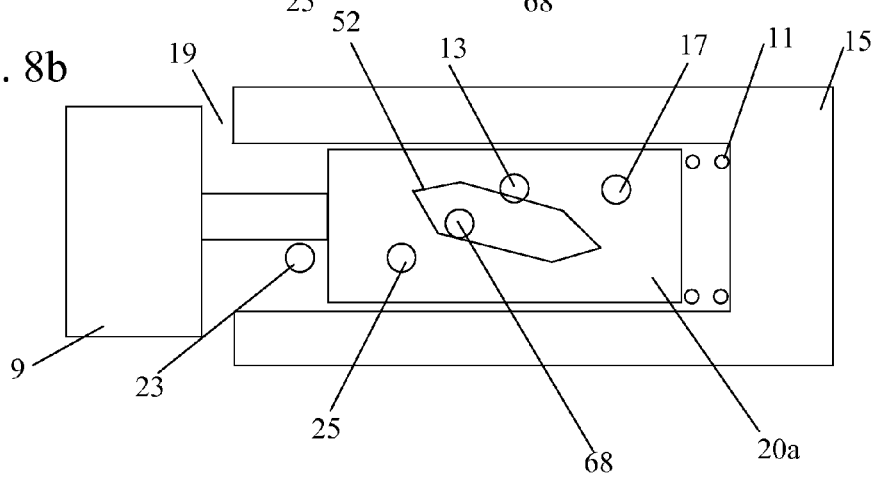
FIG. 8*b* shows the position of the spool valve and the helical slot relative to the passages leading to the chambers in the retard position shown of the phaser shown in FIG. 7*b*.
Figure 8C:
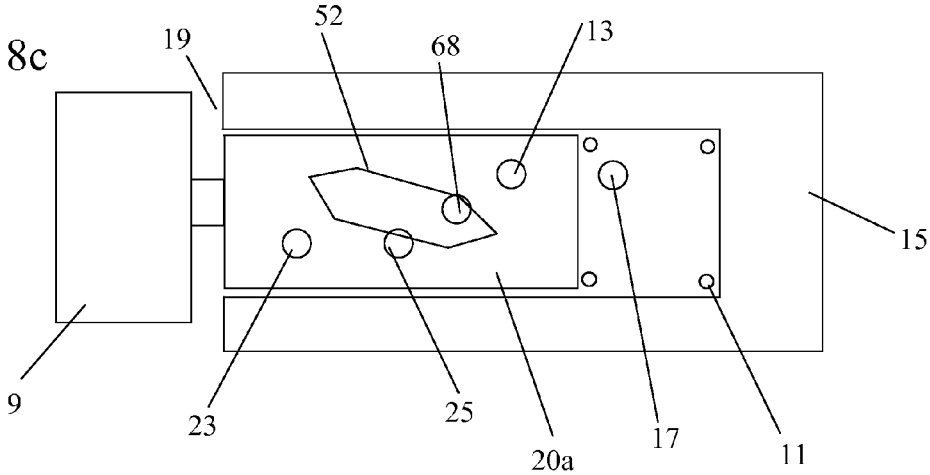
FIG. 8*c* shows the position of the spool valve and the helical slot relative to the passages leading to the chambers in the advance position shown of the phaser shown in FIG. 7*c*.

FIGS. 7*a* through 8*c* show an oil pressure actuated (OPA) phaser of a second embodiment. In an oil pressure actuated phaser, engine oil pressure is applied to one side of the vane 36, 38 or the other by a control valve 19. Oil from the opposing chamber is exhausted back to oil sump. The applied engine oil pressure alone is used to move the vanes 36, 38. FIG. 7*a* shows a schematic of the oil pressure actuated phaser of the second embodiment including a center mounted spool 20 with a helical slot 52 in an equilibrium position. FIG. 8*a* shows another view of the spool 20 with the helical slot 52 when the phaser is in an equilibrium position. FIG. 7*b* shows schematic of center mounted spool 20 relative to the passages 23, 25 17, 13 leading to the chambers when the phaser is moving towards the retard position. FIG. 8*b* shows another view of the spool 20 with the helical slot 52, when the phaser is moving towards the retard position. FIG. 7*c* shows a schematic of a center mounted spool 20 relative to the passages 23, 25 17, 13 leading to the chambers 41*a*, 41*b*, 41*c*, 41*d*, when the phaser is moving towards an advance position. FIG. 8*c* shows another view of the spool 20 with the helical slot 52 when the phaser is moving towards the advance position.

In FIGS. 7*a* and 8*a*, the oil pressure actuated phaser is in an equilibrium position. Lines 23 and 17 leading to sump are blocked by the outer circumference 20*a* of the spool 20 without slot 52. Advance and retard lines 25, 13 are partially open to slot 52 and thus line 68 connected to supply line 89. The supply line 89 connected to supply and to line 68 supplies the phaser with fluid for actuation and provides any fluid to compensate for leakage. The first advance chamber

41*a* is in fluid communication with the second advance chamber 41*c* via line 86. The first retard chamber 41*b* is in fluid communication with the second retard chamber 41*d* via line 88.

FIGS. 7*b* and 8*b* show the oil pressure actuated phaser moving towards retard. Only one set of chambers are shown for simplicity. The spool valve 19 is internally mounted in the rotor 14 with a bore receiving a spool 20 with an outer circumference 20*a* having at least one helical slot 52 and a biasing spring 11. An actuator 9, which may be controlled by an ECU, moves the spool 20 within the sleeve 15. In moving towards the retard position, the force of the actuator 9 was less than the force of a spring 11 on the opposite side of the spool 20, and the spool 20 was moved by the spring 11, until the force of the spring 11 balanced the force of the actuator 11. With the spool 20 in this position, fluid from supply 68 is supplied to the retard line 13, moving the first vane 36 and the second vane 38 in the direction shown, forcing fluid to exit the advance chambers 41*a*, 41*c* through sump line 23 to sump or atmosphere. Advance line 25 and sump line 17 are blocked by the outer circumference 20*a* of the spool without helical slot 52.

FIGS. 7*c* and 8*c* show the oil pressure actuated phaser moving towards an advance position. The spool valve 19 is internally mounted in the rotor 14 having a bore receiving a spool with at least one helical slot 52 and a biasing spring 11. An actuator 9, which may be controlled by an ECU, moves the spool 20 within the rotor 14. In moving towards the retard position, the force of the actuator 9 was greater than the force of the spring 11 on the opposite side of the spool 20, and the spool 20 was moved by the spring 11, until the force of the spring 11 balanced the force of the actuator 9. With the spool 20 in this position, fluid from supply 68 is supplied to the advance line 25, moving the first vane 36 in the direction shown, forcing fluid to exit the first and second retard chambers 41*b*, 41*d* through sump line 17 to sump or atmosphere. Retard line 13 and sump line 23 are blocked by the outer circumference 20*a* of the spool 20 without the helical slot 52.

Figure 9:
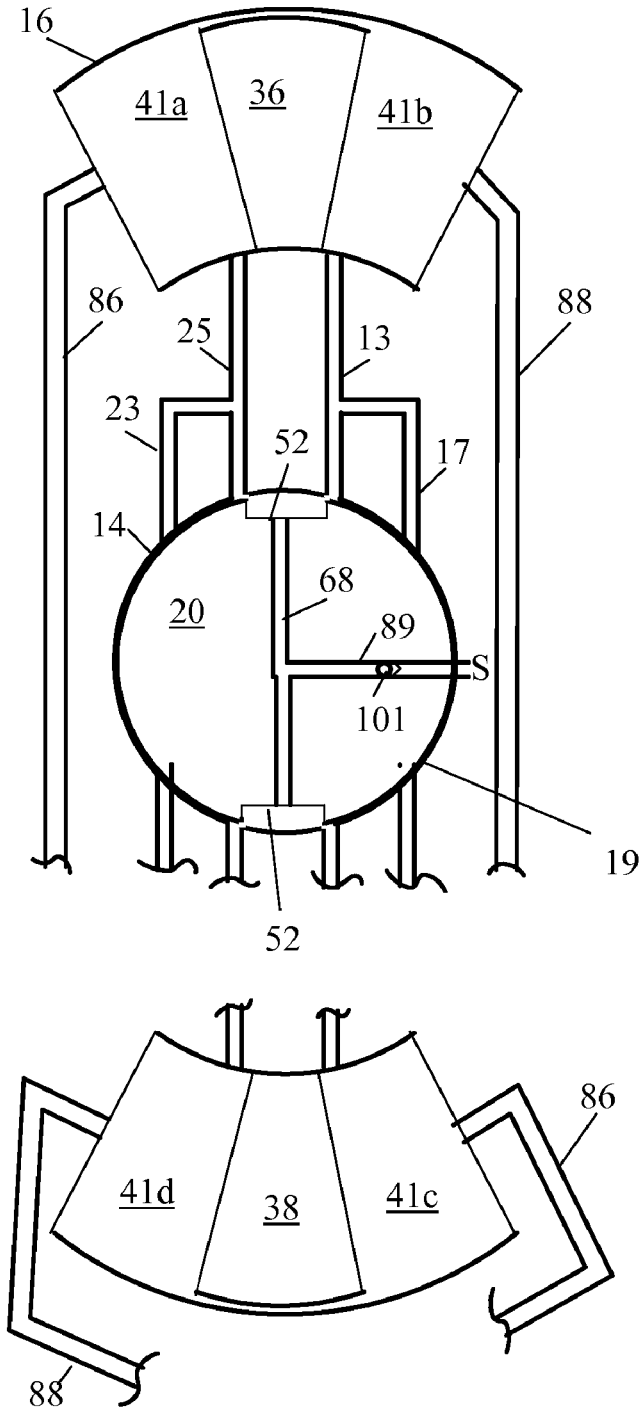
FIG. 9 shows a schematic of a torsion assist phaser of a third embodiment in an equilibrium position.

In a third embodiment, shown in FIG. 9, a torsion assist phaser may also be used with the center mounted spool 20 including a helical slot 52. In torsion assist phasers, the engine oil pressure is the main force in which moves the vanes 36, 38 in the desired direction. A check valve 101 is added in the oil supply line 89 to block oil pressure. Alternatively, two check valves may be added in the supply line to each of the chambers. U.S. Pat. No. 6,883,481 and U.S. Pat. No. 6,763,791 also disclose torsion assist phasers and are hereby incorporated by reference.

Referring to FIGS. 11, 12, and 14 through 17, a single chamber cam torque actuated (CTA) variable cam timing (VCT) phaser 210 of a fourth embodiment is shown. The phaser is mounted on an end of a camshaft (not shown) with a rotor 214 rigidly affixed onto one end. The housing 216 of the phaser has an outer circumference for accepting drive force (not shown). The rotor 214 is connected to the camshaft (not shown) and is coaxially located within the housing 216. The rotor 214 has at least one outwardly extending vane 236, dividing the cavity formed between the housing 216 and the rotor 214 into an advance chamber 241*a* and a retard chamber 241*b*. The vane 236 is capable of rotation to shift the relative angular position of the housing 216 and the rotor 214. A spool valve 219 with a spool 220 is received in a bore of the rotor 214. The spool 220 has a plurality of lands 220*b*, 220*c* each with an uncut or square edge outer circumference 220*a* and two edges 251*a*, 251*b*, 21*d*, 251*d* forming slots 252*a*, 252*b*. The two edges 251*a*, 251*b* forming the first slot 252*a* are at an angle α1 relative to each other. The two edges 251*c*, 251*d* forming the second slot 252*b* are at an angle α2 relative to each other. The α angles are preferably the same. The edge 251*a* is at an angle β1 with respect to axis 234 and the edge 251*c* is at an angle β2 with respect to axis 234. The β angles are preferably the same.

Figure 11:
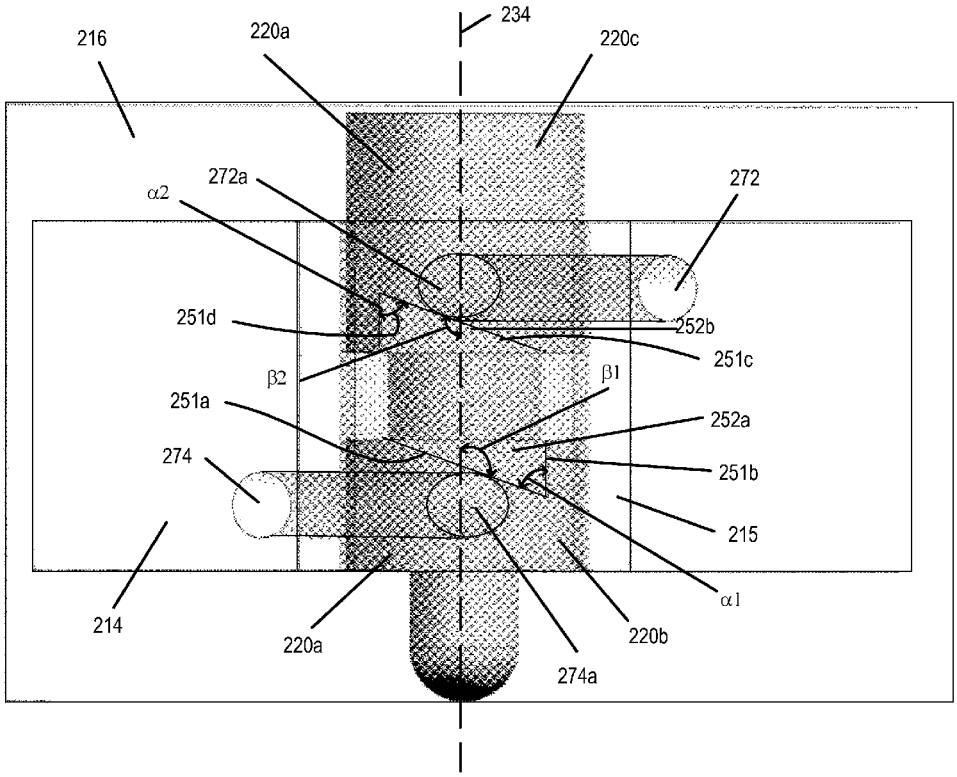
FIG. 11 shows a top down view of a spool valve of a fourth embodiment.
Figure 12:
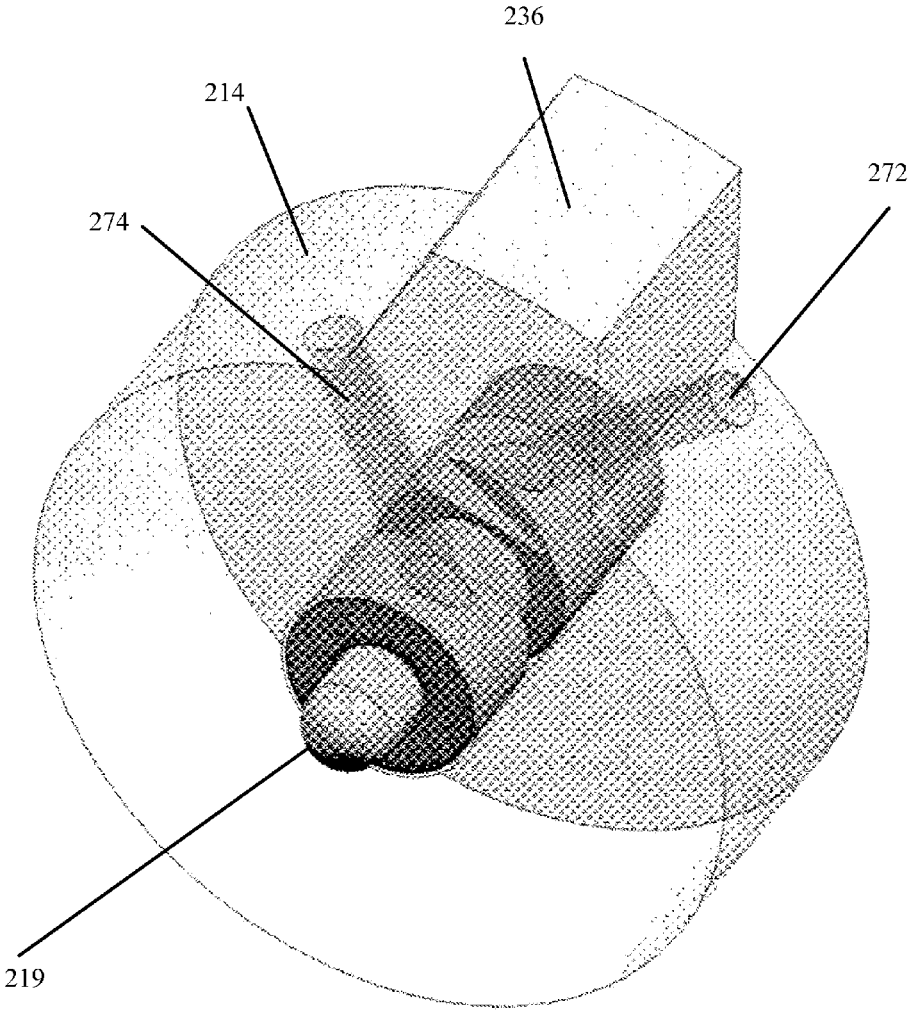
FIG. 12 shows an isometric view of the spool valve shown in FIG. 11.

Two passages 272, 274 are present in the rotor 214 and lead from the spool valve 219 to the advance chamber 241*a* and the retard chamber 241*b*. The passages 272, 274 are connected to each other through passage 268 leading to passage 266 containing check valves 270, 271. The circumferences of the inner openings or flow ports 272*a*, 274*a* of passages 272, 274 are tangent to edges 251*a*, 251*c* on the spool 220, as shown in FIG. 11 and FIG. 12.

Figure 13A:
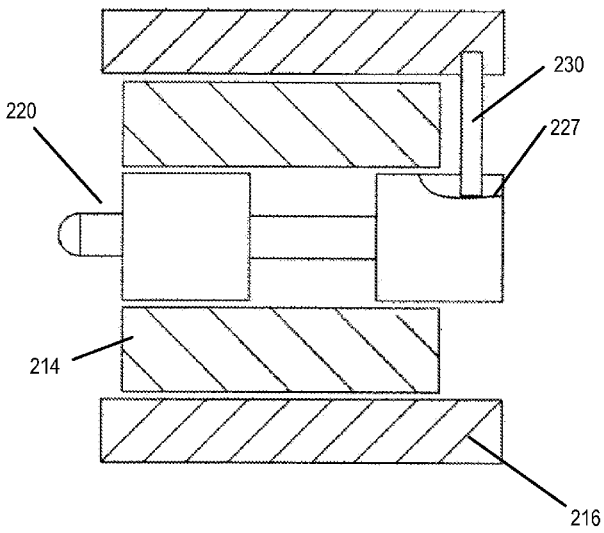
FIG. 13*a* shows a preferred way to implement an angular constraint.
Figure 13B:
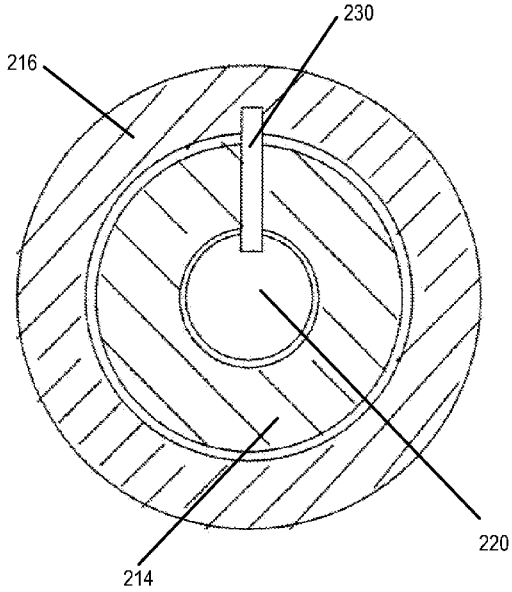
FIG. 13*b* shows a cross-sectional view of FIG. 13*a*.

FIGS. 13*a* and 13*b* shows a preferred way in which the spool 220 is engaged with the housing 216 forming an angular constraint. A pin 230 fixed to the housing 216, slides in a groove 227 on the spool 220. While the pin 230 is shown at the back of the phaser, it may also be present at the front end of the phaser. The spool valve 219 is fixed with the housing 216 through the angular constraint of the pin 230 and groove 227, such that the spool valve 219 has a fixed relative angular position with respect to the housing 216, but can move freely along the axial direction on axis 234, as shown in the figures. The angular restraint shown in FIGS. 13*a* and 13*b* may be present on the oil pressure actuated phaser and the torsion assist phaser described below.

Referring to FIGS. 14 through 18, torque reversals in the camshaft (not shown) caused by the forces of opening and closing engine valves move the vane 236. The advance and retard chambers 241*a*, 241*b* are arranged to resist positive and negative torque pulses in the camshaft and are alternatively pressurized by the cam torque. The spool valve 219 in cam torque actuated system allows the vane 236 in the phaser to move, by permitting fluid flow from the advance chamber 241*a* to the retard chamber 241*b* or vice versa, depending on the desired direction of movement.

The position of the spool 220 is influenced by spring 209 and an actuator 211 controlled by an ECU. The position of the spool 220 controls the motion, (e.g. to move towards the advance position or the retard position) of the phaser.

Figure 14:
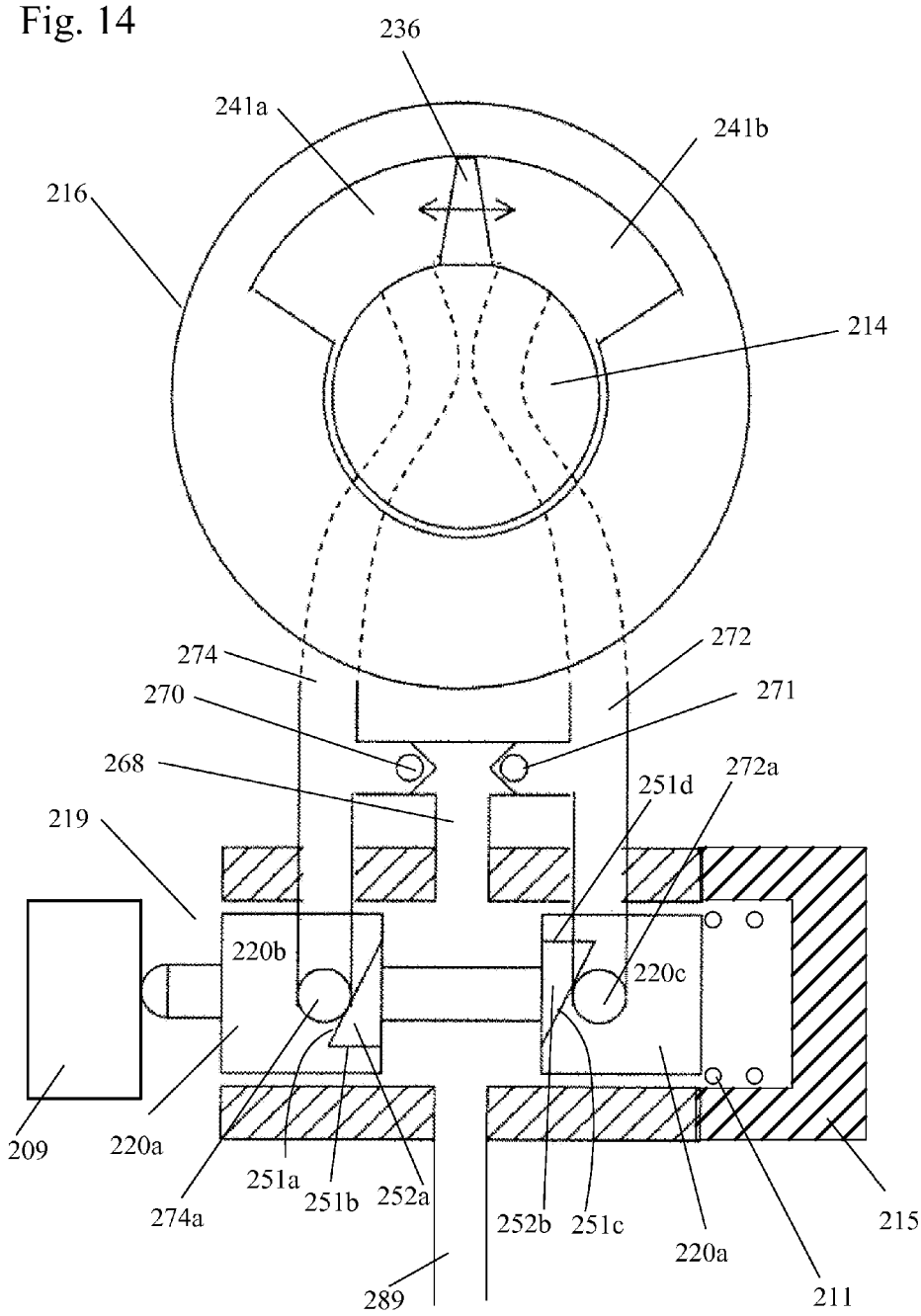
FIG. 14 shows a schematic of a cam torque actuated variable cam timing phaser of a fourth embodiment in an equilibrium position.

FIG. 14 shows CTA phaser of the fourth embodiment in an equilibrium position. In the equilibrium position, fluid is prevented from leaving lines 272 and 274 by the outer circumference 220*a* of the spool without edges 251*a*, 251*b*, 251*c*, 251*d* and from the passage 266 by check valves 270 and 271. Makeup oil is supplied to the phaser from supply S to make up for leakage and enters line 289 and through inlet check valve (not shown) to the spool valve 219. From the spool valve 219 fluid enters line 268 through either of the check valves 270, 271, to the advance chamber 241*a* or the retard chamber 241*b*.

Figure 15:
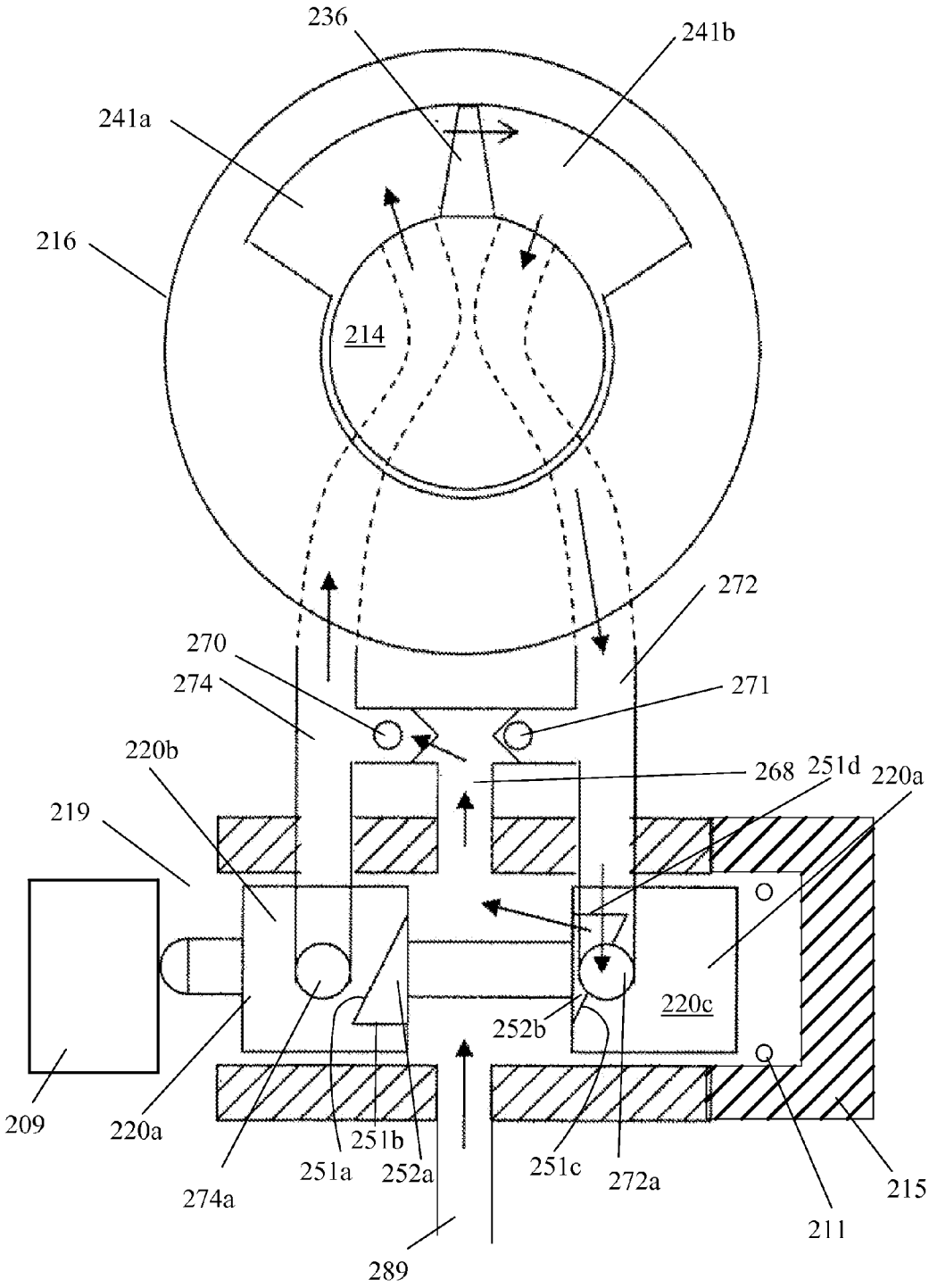
FIG. 15 shows a schematic of a cam torque actuated variable cam timing phaser of the fourth embodiment moving to the advance position.
Figure 16:
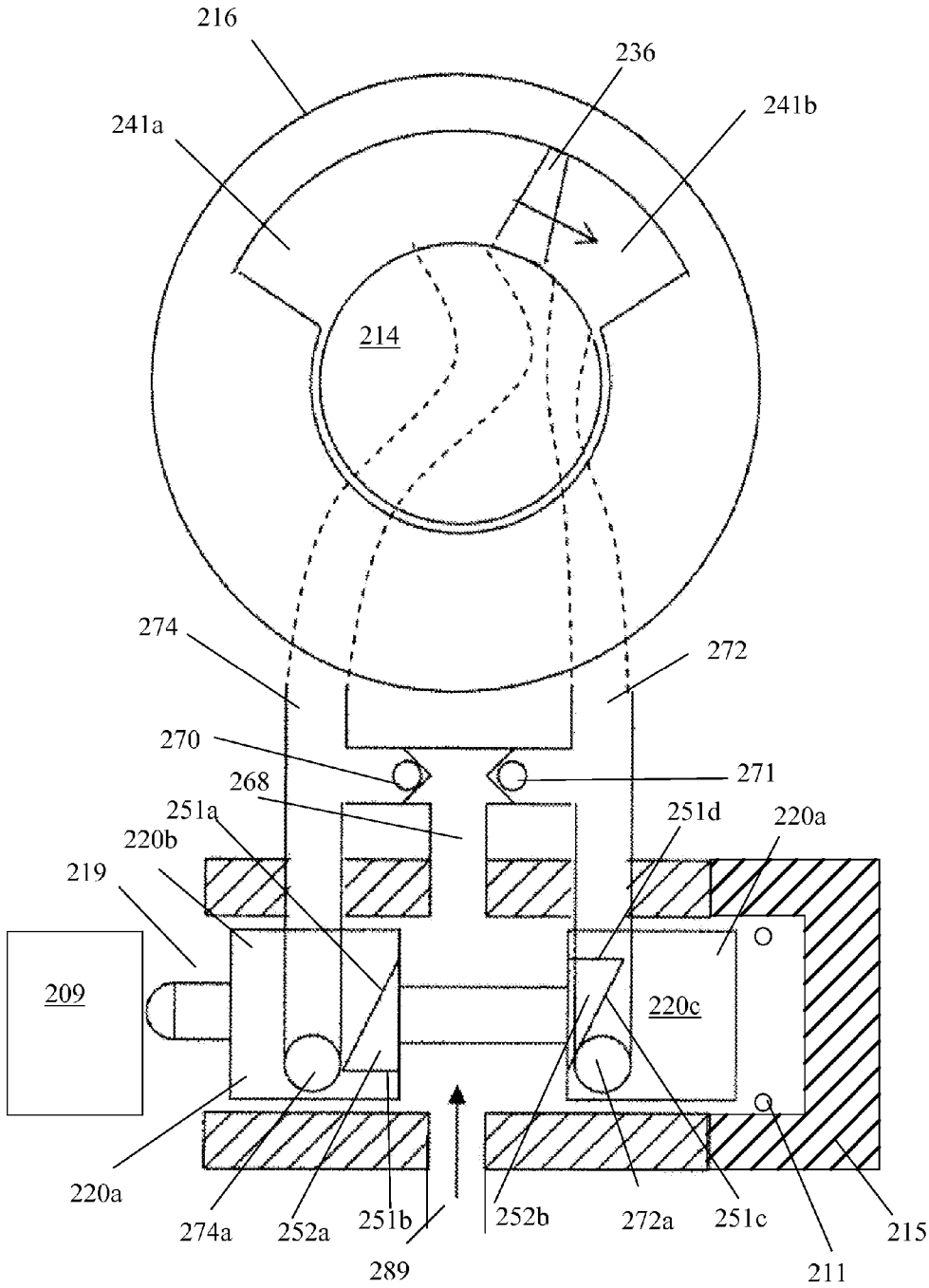
FIG. 16 shows a schematic of a cam torque actuated variable cam timing phaser of the fourth embodiment in the advance position at equilibrium.

FIG. 15 shows the CTA phaser of the fourth embodiment moving towards the advance position and FIG. 16 shows the CTA phaser of the fourth embodiment in the advance position at equilibrium.

Referring to FIG. 15, the force of the actuator 209 was increased and the spool 220 was moved to the right by the actuator 209, against the force of spring 211 in the bore 247, until the force of the spring 211 balances the force of the actuator 209. In the position shown, the outer circumference 220*a* of spool land 220*b* without edges 251*a*, 251*b*, 251*c*, 251*d* blocks the exit of fluid from line 274. Flow port 272*a* is open to slot 252*b* made by edges 251*c*. Line 268 is also open.

Camshaft torque pressurizes the retard chamber 241*b*, causing fluid in the retard chamber 241*b* to move into the advance chamber 241*a*. Fluid exiting the retard chamber 241*b* moves through line 272 and flow port 272*a*, open to slot 252*b* of the spool 220. From slot 252*b* of the spool, fluid enters line 268 and travels through open check valve 270 into line 272 and the advance chamber 241, moving the vane as shown in FIG. 16. Check valve 271 is closed. Fluid is prevented from exiting the advance chamber 41*a* by blocked port 274*a*.

As soon as the rotor 214 and vane 236 move in the advancing direction, the rotor 214 starts to cover the open flow port 272*a*. The area of the flow port 272*a* gets smaller and smaller and the vane 236 moves slower and slower as the rotor 214 continues to move in the advancing direction, reducing flow port 272*a* opening until it is blocked or closed by the outer circumference 220*a* of land 220*c* without edges 251*a*, 251*b*, 251*c*, 251*d*. Finally, the phaser stops at a new position and reaches equilibrium, where both flow ports 272*a*, and 274*a* are blocked as shown in FIG. 16.

Makeup oil is supplied to the phaser from supply to make up for leakage and enters line 268 and moves through inlet check valve (not shown) to the spool valve 219. From the spool valve 219 fluid enters line 268 through either of the check valves 270, 271, to either the advance chamber 241*a* or the retard chamber 241*b*.

Figure 17:
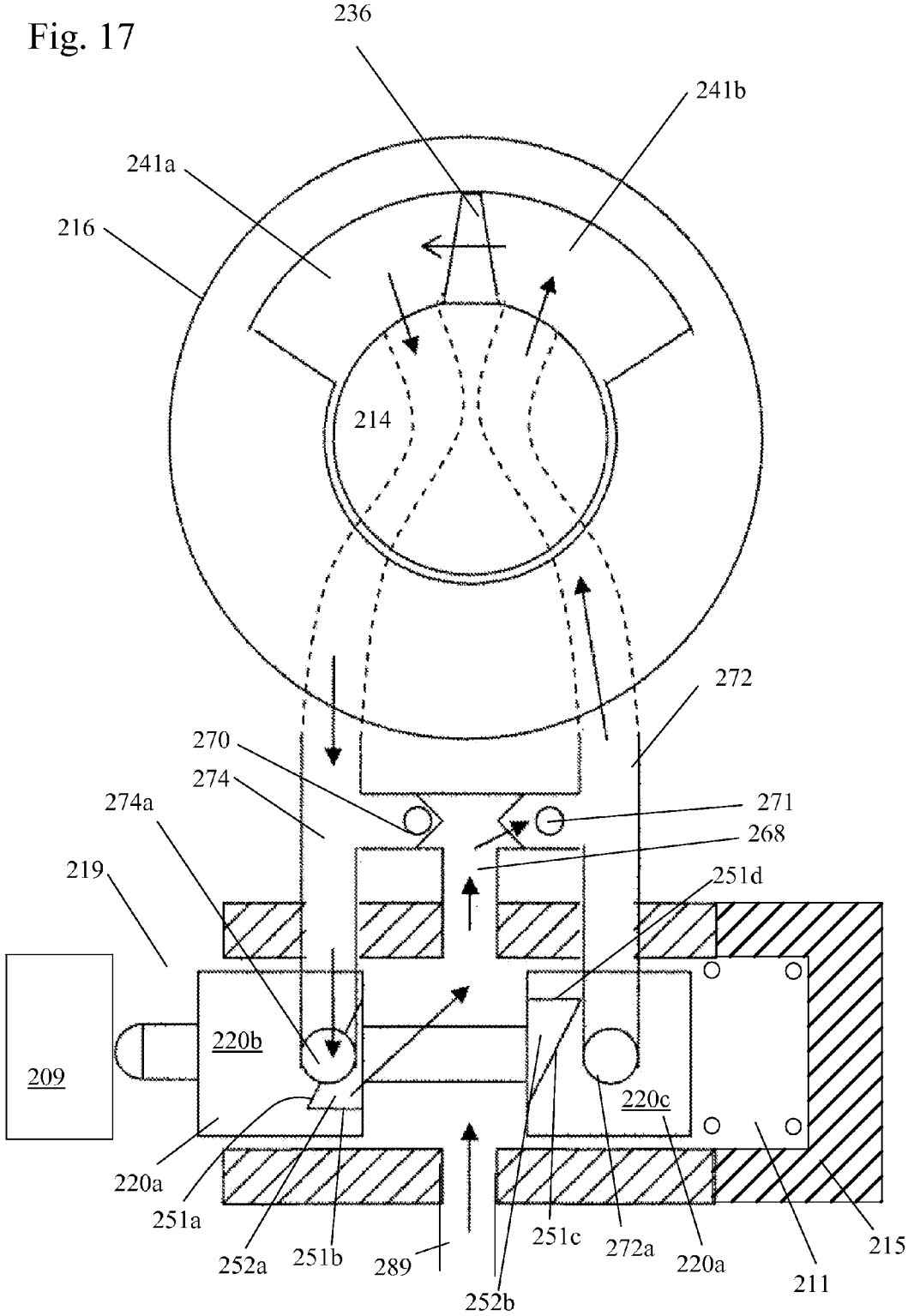
FIG. 17 shows a schematic of a cam torque actuated variable cam timing phaser of the fourth embodiment moving to the retard position.
Figure 18:
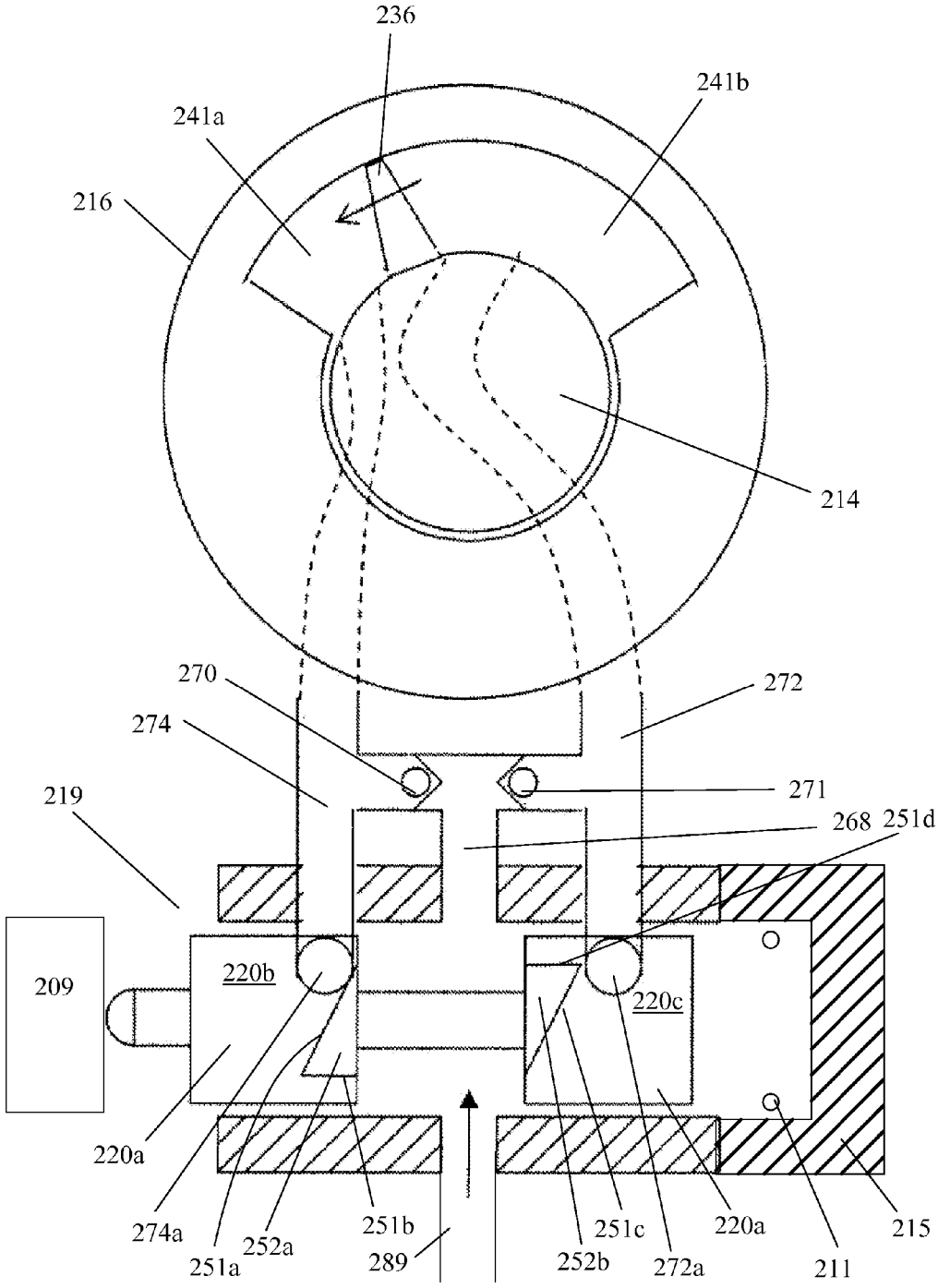
FIG. 18 shows a schematic of a cam torque actuated variable cam timing phaser of the fourth embodiment in the retard position at equilibrium.

FIG. 17 shows the CTA phaser of the fourth embodiment moving towards the retard position and FIG. 18 shows the CTA phaser of the fourth embodiment in the retard position.

Referring to FIG. 17, the force of the actuator 209 was decreased and the spool 220 was moved to the left by the spring 211, against the force of spring 211 in the bore 247, until the force of the spring 211 balances the force of the actuator 209. In the position shown, the outer circumference 220*a* of spool land 220*c* blocks the exit of fluid from line 272. Flow port 274*a* is open to slot 252*a* made by edge 251*a*. Line 268 is also open.

Camshaft torque pressurizes the advance chamber 241*a*, causing fluid in the advance chamber 241*a* to move into the retard chamber 241*b*. Fluid exiting the advance chamber 241*a* moves through line 274 and flow port 274*a*, open to slot 252*a* of the spool 220. From slot 252*a* of the spool, fluid enters line 268 and travels through open check valve 271 into line 274 and the retard chamber 241*b*, moving the vane 236 as shown in FIG. 18. Check valve 270 is closed. Fluid is prevented from exiting the retard chamber 41*b* by blocked port 272*a*.

As soon as the rotor 214 and vane 236 move in the retard direction, the rotor 214 starts to cover the open flow port 274*a*. The area of the flow port 274*a* gets smaller and smaller and the vane 236 moves slower and slower as the rotor 214 continues to move in the retard direction, reducing flow port 274*a* opening until it is blocked or closed by the outer circumference 220*a* of land 220*b* without edges 251*a*, 251*b*, 251*c*, 251*d*. Finally, the phaser stops at a new position and reaches equilibrium, where both flow ports 272*a*, and 274*a* are completely blocked, by spool lands 220*b*, 220*c* as shown in FIG. 18.

Makeup oil is supplied to the phaser from supply to make up for leakage and enters line 268 and moves through inlet check valve (not shown) to the spool valve 219. From the spool valve 219 fluid enters line 268 through either of the check valves 270, 271, to either the advance chamber 241*a* or the retard chamber 241*b*.

Figure 19:
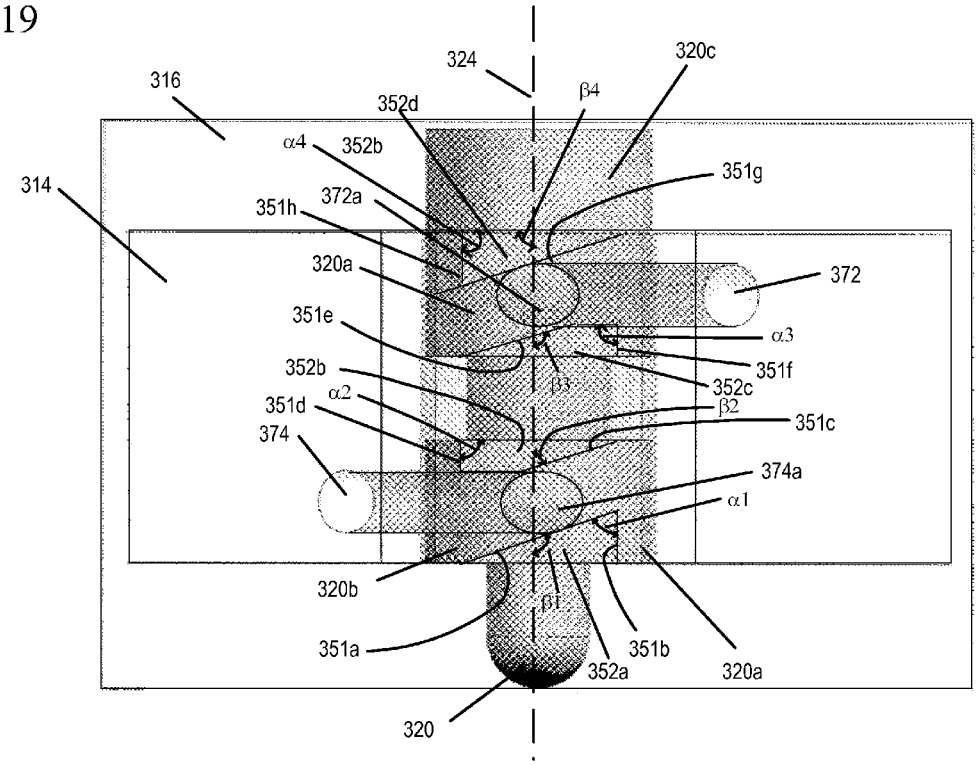
FIG. 19 shows a top down view of the spool valve of an oil pressure actuated variable cam timing phaser of a fifth embodiment.
Figure 20:
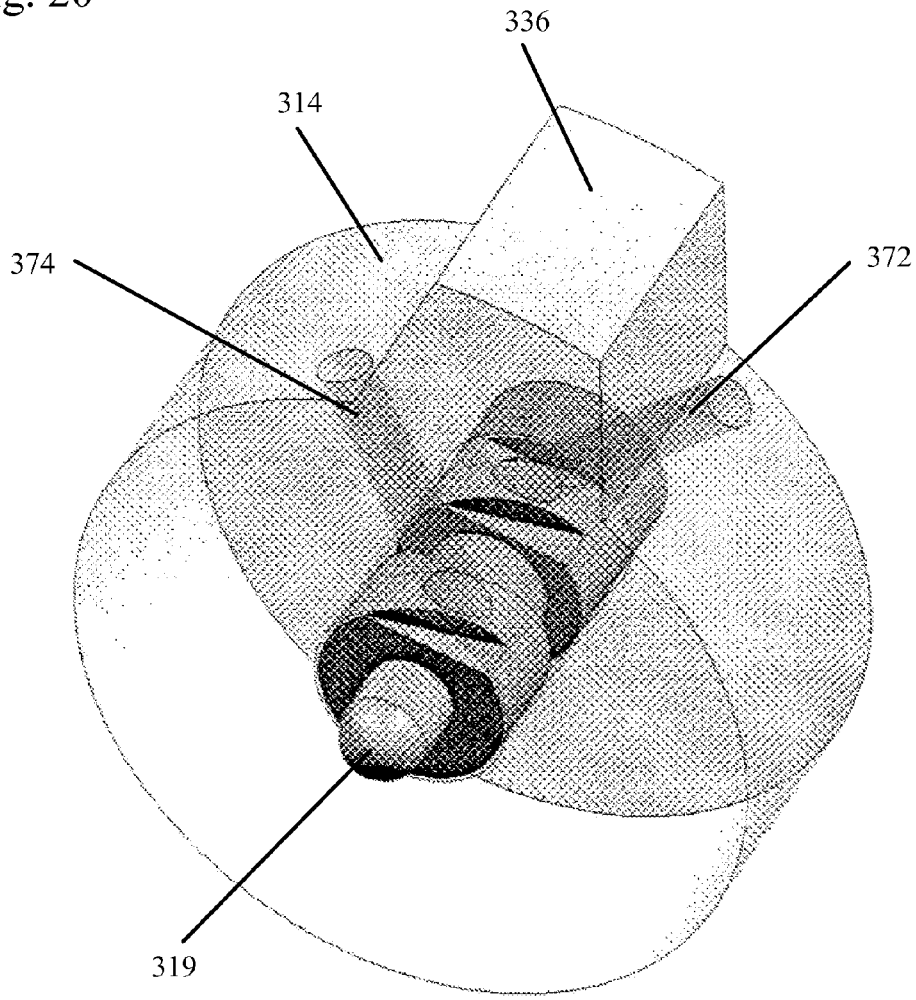
FIG. 20 shows an isometric view of an oil pressure actuated variable cam timing phaser of a fifth embodiment.

FIGS. 19 and 20 show an oil pressure actuated (OPA) variable cam timing (VCT) phaser 310. The phaser is mounted on an end of a camshaft (not shown) with a rotor 314 rigidly affixed onto one end. The housing 316 of the phaser has an outer circumference for accepting drive force. The rotor 314 is connected to the camshaft (not shown) and is coaxially located within the housing 316. The rotor 314 has at least one outwardly extending vane 336, dividing the cavity 340 formed between the housing 316 and the rotor 314 into an advance chamber 341*a* and a retard chamber 341*b*. The vane 336 is capable of rotation to shift the relative angular position of the housing 316 and the rotor 314. The rotor 314 also has a bore 347 with a sleeve 315 that slidably receives a spool valve 319 with a spool 320. The spool 320 has a plurality of lands 320*b*, 320*c* each with an uncut or square edge outer circumference 320*a* and slots 352*a*, 352*b*, 352*c*, 352*d*. With land 320*b* having slots 352*a* and 352*b* and land 320*c* having slots 352*c* and 352*d*. Each slot is made by two edges at an angle $\alpha$ to each other. Slot 352*a* is formed by edges 351*a* and 351*b* at an angle $\alpha 1$ relative to each other. Slot 352*b* is formed by edges 351*c* and 351*d* at an angle $\alpha 2$ relative to each other. Slot 352*c* is formed by edges 351*e* and 351*f* at an angle $\alpha 3$ relative to each other. Slot 352*d* is formed by edges 351*g* and 351*h* at an angle $\alpha 4$ relative to each other. The $\alpha$ angles are preferably the equal. The edge 351*a* is at an angle $\beta 1$ with respect to axis 334, the edge 351*c* is at an angle $\beta 2$ with respect to axis 334, the edge 351*e* is at an angle $\beta 3$ with respect to axis 334, and the edge 351*g* is at an angle $\beta 4$ with respect to axis 334. The $\beta$ angles are preferably equal. Edges 351*a*, 351*c*, 351*e*, 351*g* are preferably are parallel to each other. A supply line 389 provides oil from a supply to the spool valve 319.

Two passages 372 and 374 are present in the rotor 314 and lead from the spool valve 319 to the advance chamber 341*a* and the retard chamber 341*b*. The circumferences of the inner openings or flow ports 372*a*, 374*a* of passages 372, 374 are tangent to both edges 351*a*, 351*c*, 351*e*, 351*g* on the spool 320, as shown in FIGS. 19 and 20.

FIGS. 21 through 26 show an oil pressure actuated (OPA) phaser of a fifth embodiment. In an oil pressure actuated phaser, engine oil pressure is applied to one side of the vane 336 or the other by a spool valve 319. Oil from the opposing chamber is exhausted back to oil sump. The applied engine oil pressure alone is used to move the vane 336.

Figure 21:
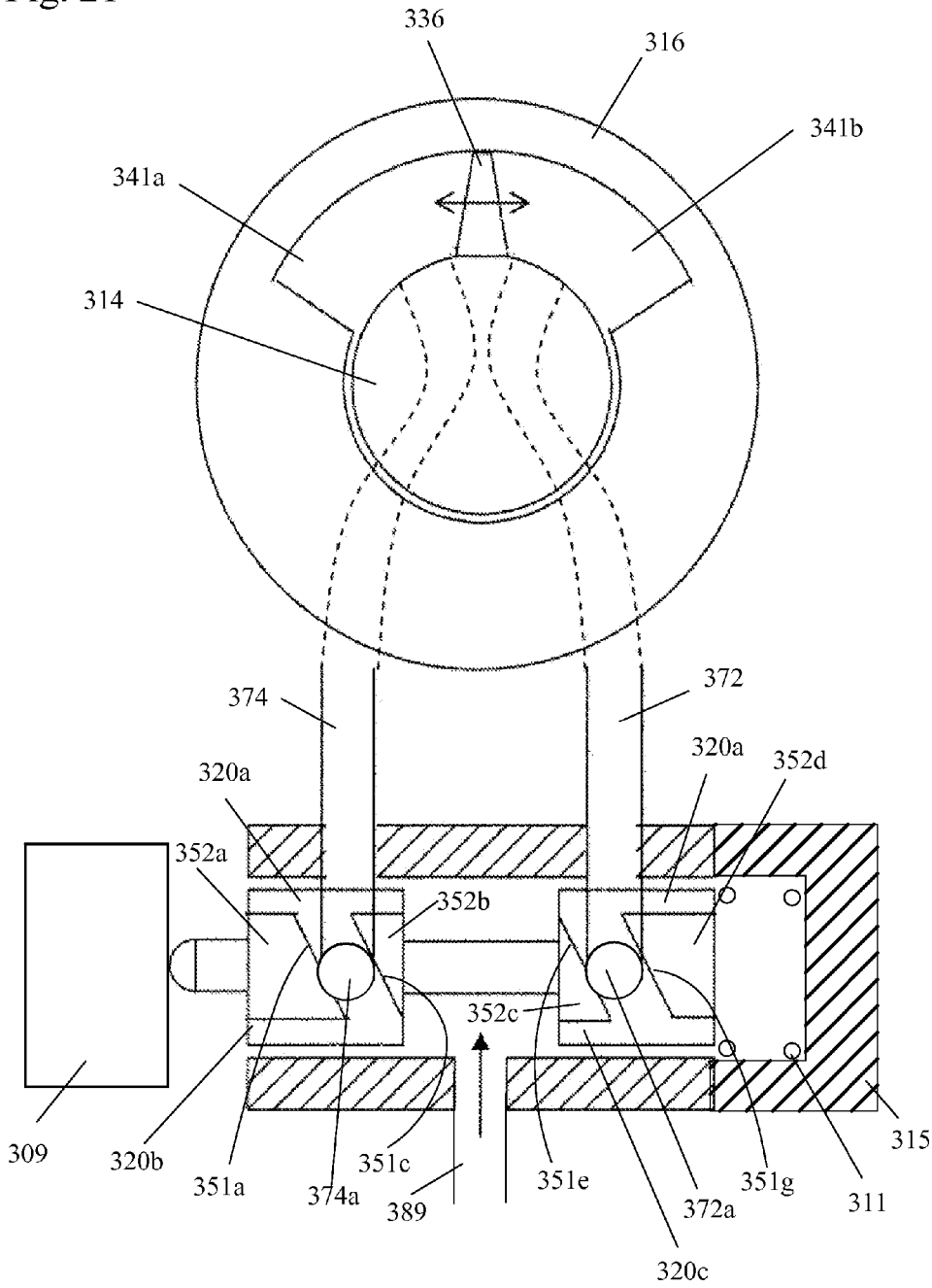
FIG. 21 shows a schematic of an oil pressure actuated variable cam timing phaser of a fifth embodiment in an equilibrium position.

FIG. 21 shows the oil pressure actuated phaser in equilibrium steady state position. Fluid is prevented from moving from the advance chamber 341*a* to the retard chamber 341*b* or vice versa. Ports 374*a* and 372*a* of passages 372, 374 are partially open a small amount to receiving makeup fluid to from supply line 389 as necessary.

Figure 22:
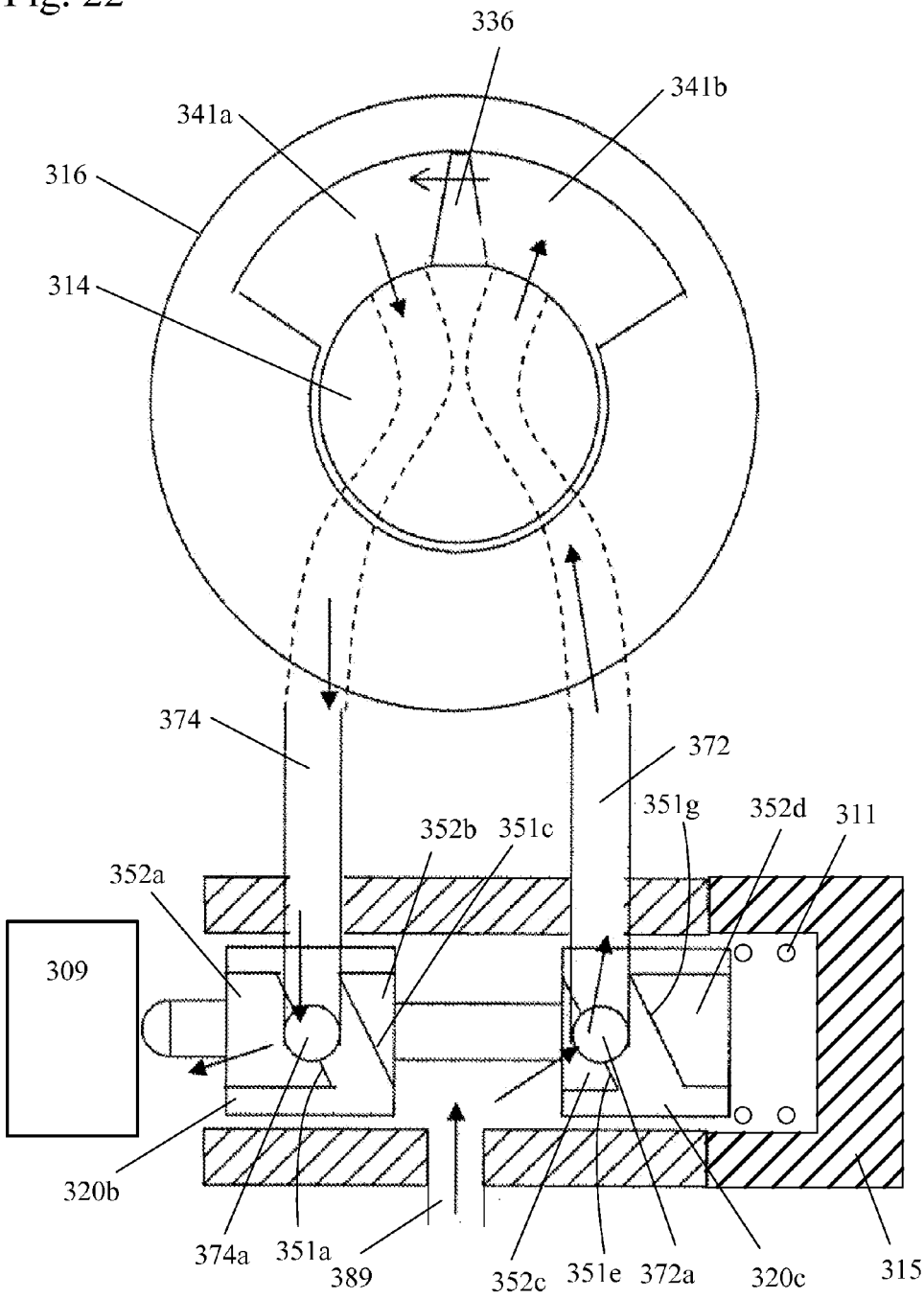
FIG. 22 shows an oil pressure actuated variable cam timing phaser of a fifth embodiment moving to the retard position.
Figure 23:
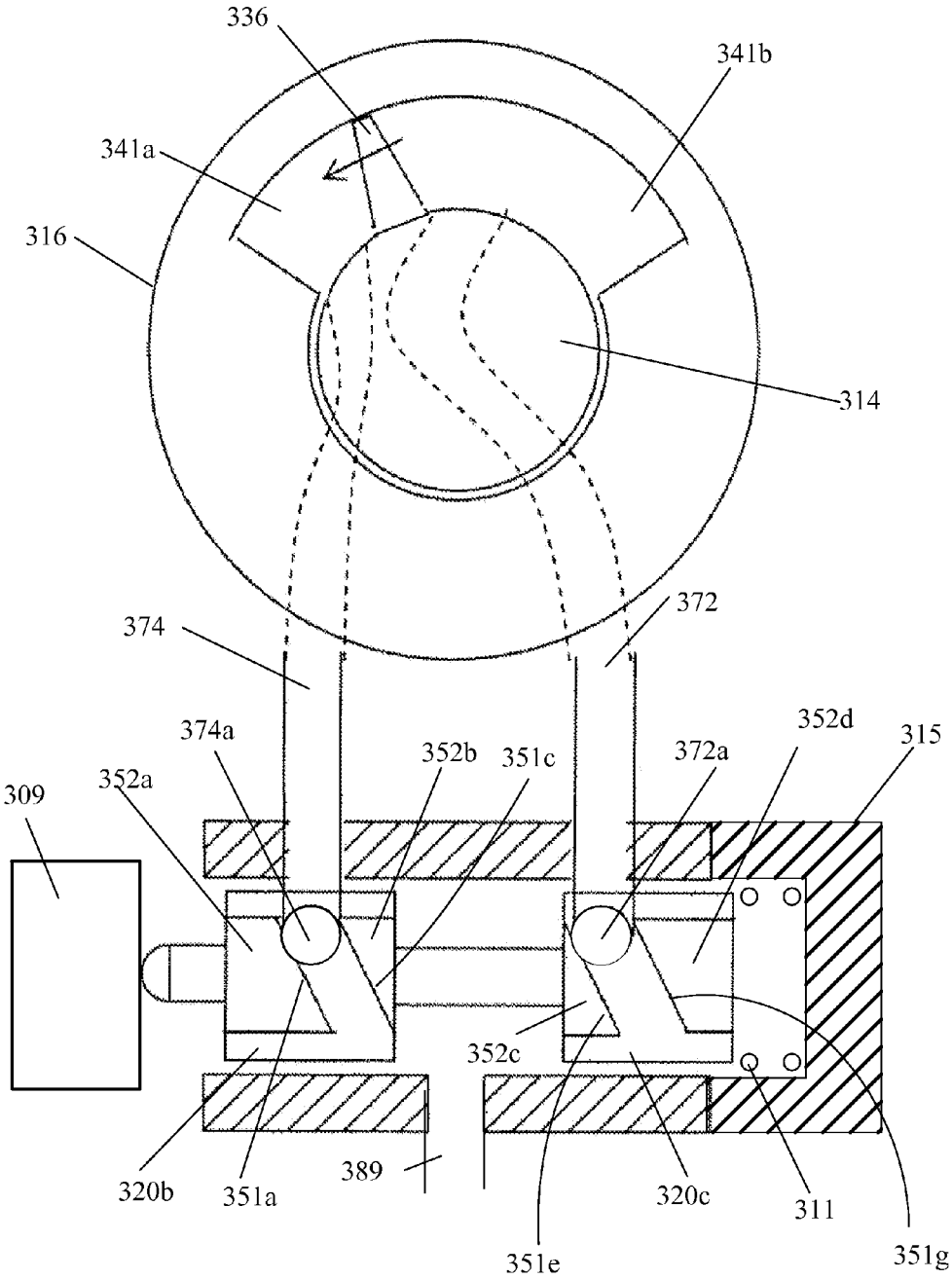
FIG. 23 shows a schematic of an oil pressure actuated variable cam timing phaser of a fifth embodiment in the retard position at equilibrium.

FIGS. 22 shows the OPA phaser of the fifth embodiment moving towards the retard position and FIG. 23 shows the OPA phaser of the fifth embodiment in the retard position.

Referring to FIG. 22, the force of the actuator 309 was increased and the spool 320 was moved to the right by the spring 311, until the force of the spring 311 balances the force of the actuator 309. In the position shown, flow ports 374*a* and 372*a* are open to slots 352*a* and 352*c*. More specifically, flow port 374*a* is open to slot 352*a* on edge 351*a* and flow port 372*a* is open to slot 352*c* on edge 351*e*. Through the slot 352*a* made by angular edges 351*a* and 351*b*, flow port 374*a* is open to the atmosphere and slot 352*c* made by angular edges 351*e* and 351*f*, flow port 372*a* is open to the source oil supply from line 389. Assuming the source oil pressure is adequate, fluid from supply line 389 enters port 372*a* and moves through line 372 to the retard chamber 341*b*, moving the vane 336 in the direction shown in FIG. 23, forcing fluid in the advance chamber 341*a* to exit. Fluid from the advance chamber 341*a* exits through line 374 and through port 374*a* leading to sump or atmosphere.

As soon as the OPA phaser rotates in retard direction, the rotor starts to cover both of the open flow ports 372*a*, 374*a*. The exposed flow port areas 372*a*, 374*a* become smaller and smaller. Consequently, the SOPA phaser moves slower and slower. Finally, the SOPA phaser stops at a new equilibrium position when the flow ports 372*a*, 374*a* are partially open to receive makeup fluid from supply line 389, as shown in FIG. 23.

Figure 24:
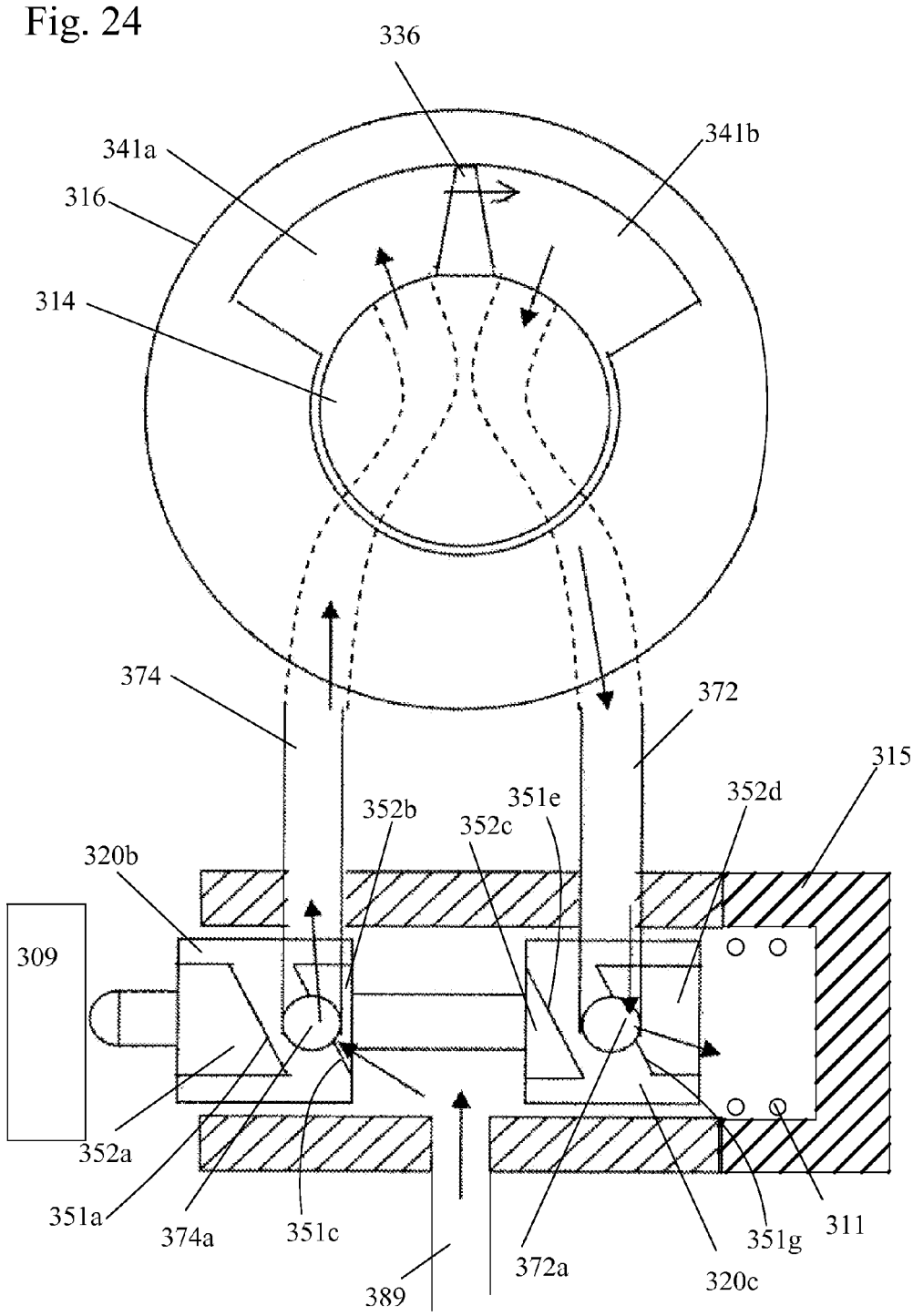
FIG. 24 shows a schematic of an oil pressure actuated variable cam timing phaser of a fifth embodiment moving to the advance position.
Figure 25:
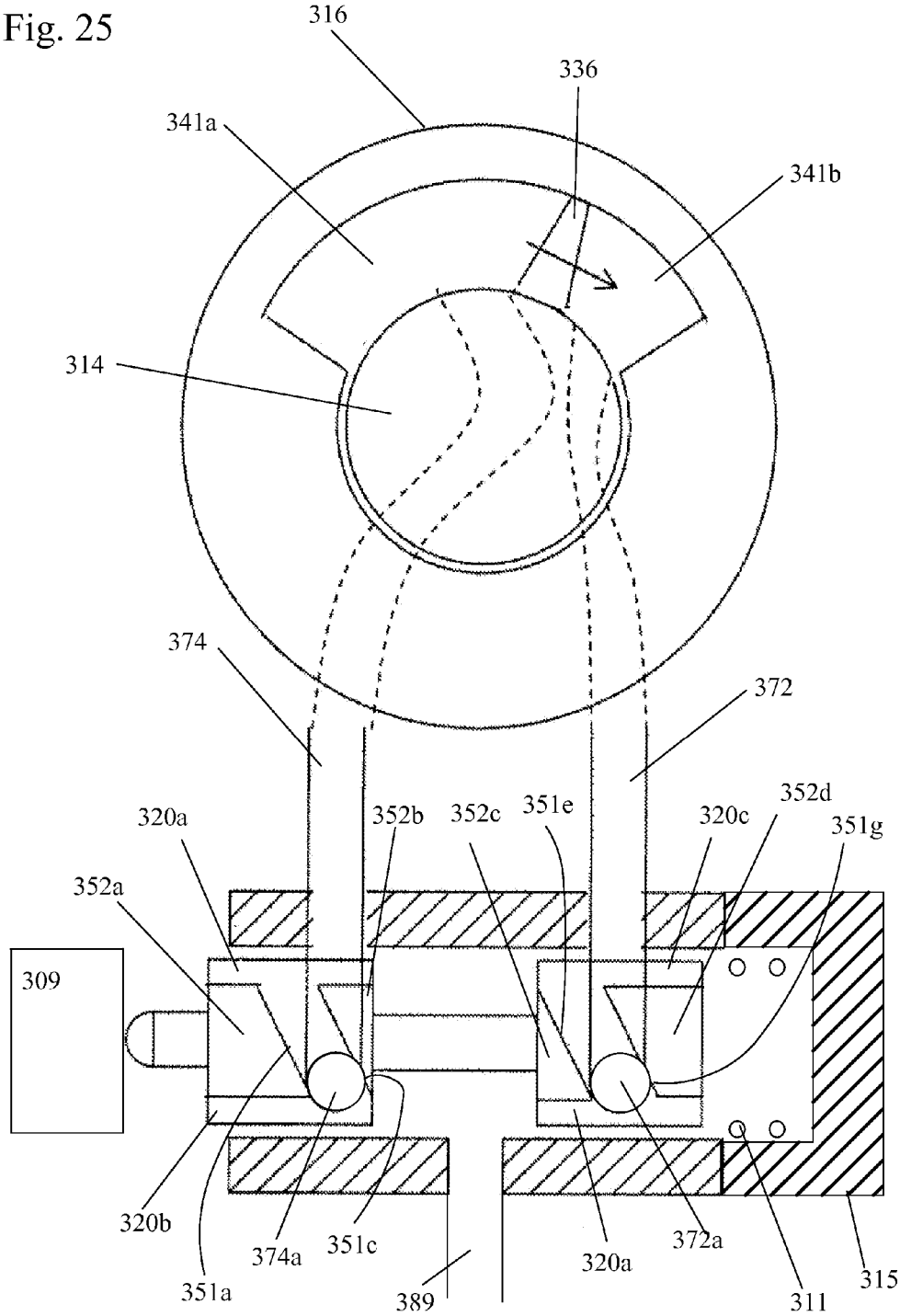
FIG. 25 shows a schematic of an oil pressure actuated variable cam timing phaser of a fifth embodiment in the advance position at equilibrium.

FIGS. 24 shows the OPA phaser of the fifth embodiment moving towards the advance position and FIG. 25 shows the OPA phaser of the fifth embodiment in the advance position.

Referring to FIG. 24, the force of the actuator 309 was decreased and the spool 320 was moved to the left by the spring 311, against the force of spring 311 in the bore 347, until the force of the spring 311 balances the force of the actuator 309. In the position shown, flow ports 374*a* and 372*a* are open to slots 352*b* and 352*d*. More specifically, flow port 374*a* is open to slot 352*b* on edge 351*c* and flow port 372*a* is open to slot 352*d* on edge 351*g*. Through the slot 352*b* made by angular edge 351*c* and 351*d*, flow port 374*a* is open to the source oil supply from line 389 and slot 352*d* made by angular edge 351*g* and 351*h*, flow port 372*a* is open to the atmosphere or sump. Assuming the source oil pressure is adequate, fluid from supply line 389 enters port 374*a* and moves through line 374 to the advance chamber 341*a*, moving the vane 336 in the direction shown in FIG. 25, forcing fluid in the retard chamber 341*b* to exit. Fluid from the retard chamber 341*b* exits through line 372 and through port 372*a* leading to sump or atmosphere.

As soon as the OPA phaser rotates in advance direction, the rotor starts to cover both of the open flow ports 372*a*, 374*a*. The exposed flow port areas 372*a*, 374*a* become smaller and smaller. Consequently, the OPA phaser moves slower and slower. Finally, the OPA phaser stops at a new equilibrium position when the flow ports 372*a*, 374*a* are partially open to receive makeup fluid from supply line 389, as shown in FIG. 25.

Figure 26:
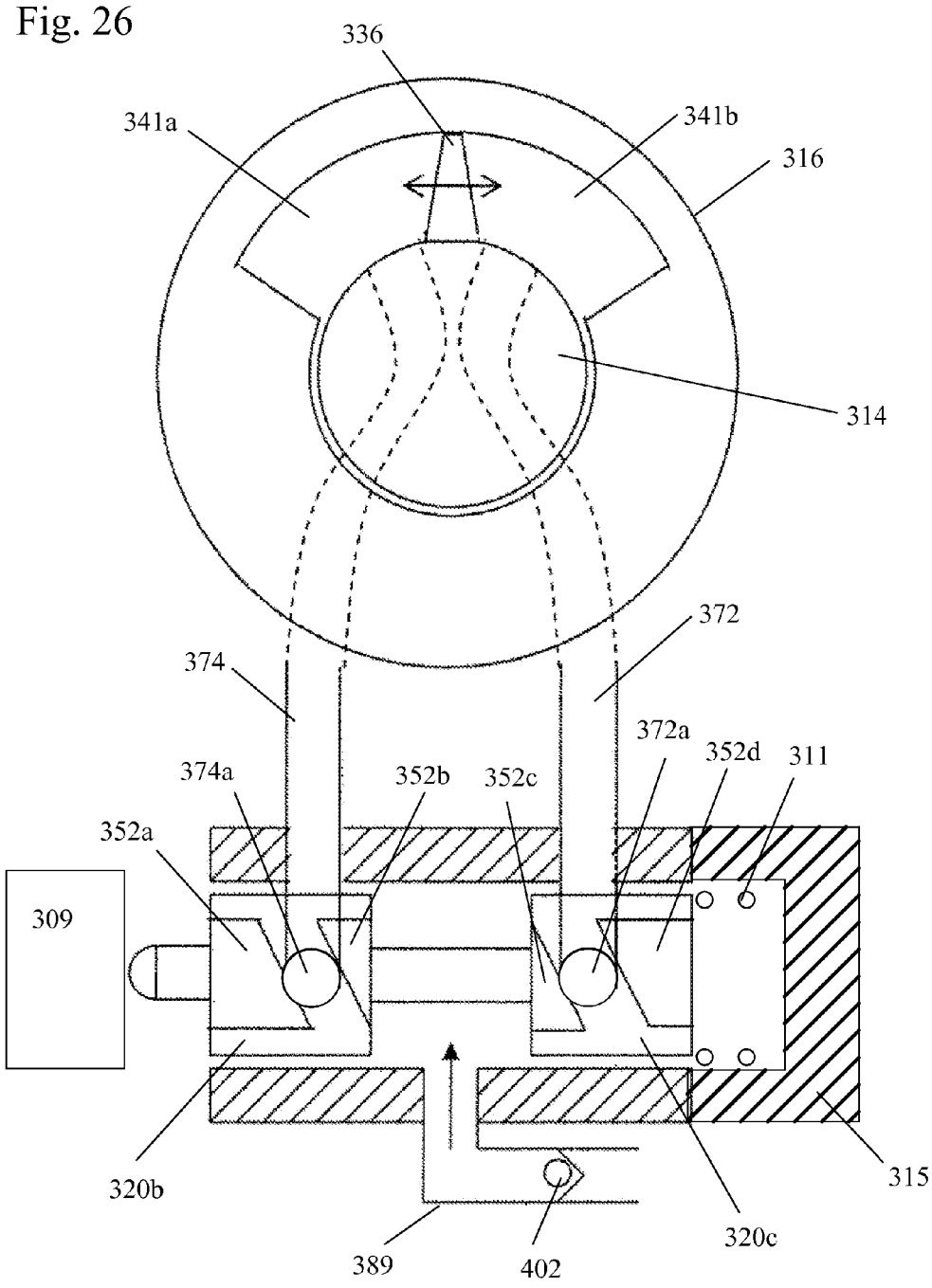
FIG. 26 shows a schematic of a torsional assist variable cam timing phaser of a sixth embodiment.

FIG. 26 shows a torsion assist (TA) phaser of a sixth embodiment. The torsion assist phaser operates in the same way as OPA phaser with added benefit of using alternating cam torque to help moving VCT by including an inlet check valve 402 in line 389. U.S. Pat. No. 6,883,481 and U.S. Pat. No. 6,763,791 also disclose torsion assist phasers and are hereby incorporated by reference.

By utilizing a center-mounted spool which is located rotationally to the housing as the control valve in the fourth, fifth, and sixth embodiments, the spool has two helical slots which serve to regulate the flow to the advance and retard chambers. Axial displacement or translational movement of the spool allows either the advance or retard chambers to communicate with the common chamber such as common passage of rotor or a supply line. This results in the rotor displacing rotationally until the common chamber or supply line no longer communicates with either the advance or retard chambers. At this point a new equilibrium rotational position for the rotor relative to the housing/spool is reached. Displacements of the rotor from the null position are counteracted by the common chamber or supply line communicating to either the advance and retard chambers. Therefore the rotational position is directly related to the axial position of the center spool.

The center spool can be positioned with or actuated upon by such actuators as a variable force solenoid, step motor of by a pressure/force balance (a pressure on one side of the spool reacting against a spring), etc.

Slot as used in the present application is defined as a passage or opening recessed into the outside circumference of the spool.

The spool valves described above may also be used with a hybrid phaser, which is a CTA phaser with proportional oil pressure as discussed in U.S. Pat. No. 6,997,150 which is hereby incorporated by reference.

The actuator in the above embodiments may a variable force solenoid, an differential pressure control system, a regulated pressure control system, or other similar actuators.

In phasers of the above embodiments, the axial position of the spool directly determines the angle or phase between the rotor and housing as shown in FIG. 10. By having a direct relationship between the axial spool position and the phase angle, a less complicated control system is therefore needed. In conventional phasers, there is a direct relationship between axial spool position and the rate of change of the phaser, therefore needing a higher performance feedback system to control the phaser.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A phaser for an internal combustion engine comprising:

a housing having an outer circumference for accepting drive force;

a rotor for connection to a camshaft coaxially located within the housing having at least one vane, wherein the housing and the rotor define at least one chamber, separated by the vane into an advance chamber and a retard chamber, the vane being capable of rotation to shift relative angular position of the housing and the rotor;

a control valve comprising a spool having at least one land and at least one slot on an outer circumference of the spool defined by at least two edges at an angle, slidably mounted within a bore in the rotor, the spool being moveable to at least a first position, a second position, and a third position;

an advance passage connecting the advance chamber to the control valve;

a retard passage connecting the retard chamber to the control valve and a common passage connecting the advance passage to the retard passage having at least one check valve;

a means for connecting the housing to the spool, such that the spool rotates with the housing and moves translationally relative to the rotor; and a supply line for supplying fluid to the spool valve of the phaser having a first end connected to supply and a second end connected to the spool valve;

wherein when the spool is in the first position, the slot on the outer circumference of the spool is in fluid communication with the supply line and the common passage;

wherein when the spool is moving to the second position, the slot on the outer circumference of the spool is in fluid communication with the supply line, the retard passage and the common passage, allowing fluid flow between the retard chamber and the advance chamber;

wherein when the spool is moving to the third position, the slot on the outer circumference of the spool is in fluid communication with the supply line, the advance passage and the common passage, allowing fluid flow between the advance chamber and the retard chamber; and wherein the angles and placements of the edges of the slot are positioned such that the phase angle directly relates to an axial position of the spool.

2. The phaser of claim 1, further comprising a check valve in the supply line.

3. A phaser for an internal combustion engine comprising:

a housing having an outer circumference for accepting drive force;

a rotor for connection to a camshaft coaxially located within the housing having at least one vane, wherein the housing and the rotor define at least one chamber, separated by the vane into an advance chamber and a retard chamber, the vane being capable of rotation to shift relative angular position of the housing and the rotor;

a control valve comprising a spool having at least one land and at least one slot on an outer circumference of the spool defined by at least two edges at an angle, slidably mounted within a bore in the rotor, the spool being moveable to at least a first position, a second position, and a third position;

an advance passage connecting the advance chamber to the control valve and an advance sump passage connecting the advance chamber to sump;

a retard passage connecting the retard chamber to the control valve and a retard sump passage connecting the retard chamber to sump;

a means for connecting the housing to the spool, such that the spool rotates with the housing and moves translationally relative to the rotor; and a supply line for supplying fluid to the spool valve of the phaser having a first end connected to supply and a second end connected to the spool valve;

wherein when the spool is in the first position, the slot on the outer circumference of the spool is in fluid communication with the supply line and partially open advance passage and retard passage;

wherein when the spool is moving to the second position, the slot on the outer circumference of the spool is in fluid communication with the supply line, and the retard passage, and the advance sump passage is open to sump, allowing fluid flow to the retard chamber and exhausting fluid from the advance chamber to sump; and wherein when the spool is moving to the third position, the slot on the outer circumference of the spool is in fluid communication with the supply line, and the advance passage, and the retard sump passage is open to sump, allowing fluid flow to the advance chamber and exhausting fluid from the retard chamber to sump;

wherein the angles and placements of the edges of the slot are positioned such that the phase angle directly relates to an axial position of the spool.

4. The phaser of claim 3, further comprising a check valve in the supply line.

5. A phaser for an internal combustion engine comprising:

a housing having an outer circumference for accepting drive force;

a rotor for connection to a camshaft coaxially located within the housing having at least one vane, wherein the housing and the rotor define at least one chambers, separated by the vane into an advance chamber and a retard chamber, the vane being capable of rotation to shift relative angular position of the housing and the rotor;

a control valve comprising a spool having at least two lands and at least one slot on an outer circumference of each land of the spool defined by at least two edges at an angle, slidably mounted within a sleeve received by a bore in the rotor, the spool being moveable to at least a first position, a second position, and a third position;

an advance passage connecting the advance chamber to the control valve;

a retard passage connecting the retard chamber to the control valve and a common passage connecting the advance passage to the retard passage having at least one check valve;

a means for connecting the housing to the spool, such that the spool rotates with the housing and moves translationally relative to the rotor; and a supply line for supplying fluid to the spool valve of the phaser having a first end connected to supply and a second end connected to the spool valve;

wherein when the spool is in the first position, the slots on the outer circumference of each of the lands of the spool is in fluid communication with the supply line and the common passage;

wherein when the spool is moving to the second position, the slot on the outer circumference of the spool is in fluid communication with the supply line, the retard passage and the common passage, allowing fluid flow between the retard chamber and the advance chamber;

wherein when the spool is moving to the third position, the slot on the outer circumference of the spool is in fluid communication with the supply line, the advance passage and the common passage, allowing fluid flow between the advance chamber and the retard chamber; and wherein the angles and placements of the edges of the slot are positioned such that the phase angle directly relates to an axial position of the spool.

6. The phaser of claim 5, further comprising a check valve in the supply line.

7. The phaser of claim 5, wherein the at least two edges are parallel to each other.

8. A phaser for an internal combustion engine comprising:

a housing having an outer circumference for accepting drive force;

a rotor for connection to a camshaft coaxially located within the housing having at least one vane, wherein the housing and the rotor define at least one chambers, separated by the vane into an advance chamber and a retard chamber, the vane being capable of rotation to shift relative angular position of the housing and the rotor;

a control valve comprising a spool having at least two lands and at least one slot on an outer circumference of each land of the spool defined by at least two edges at an angle, slidably mounted within a sleeve received by a bore in the rotor, the spool being moveable to at least a first position, a second position, and a third position;

an advance passage connecting the advance chamber to the control valve and an advance sump passage connecting the advance chamber to sump;

a retard passage connecting the retard chamber to the control valve and a retard sump passage connecting the retard chamber to sump;

a means for connecting the housing to the spool, such that the spool rotates with the housing and moves translationally relative to the rotor; and a supply line for supplying fluid to the spool valve of the phaser having a first end connected to supply and a second end connected to the spool valve;

wherein when the spool is in the first position, the slot on the outer circumference of the spool is in fluid communication with the supply line and partially open advance passage and retard passage;

wherein when the spool is moving to the second position, the slot on the outer circumference of the spool is in fluid communication with the supply line, and the retard passage, and the advance sump passage is open to sump, allowing fluid flow to the retard chamber and exhausting fluid from the advance chamber to sump; and wherein when the spool is moving to the third position, the slot on the outer circumference of the spool is in fluid communication with the supply line, and the advance passage, and the retard sump passage is open to sump, allowing fluid flow to the advance chamber and exhausting fluid from the retard chamber to sump;

wherein the angles and placements of the edges of the slot are positioned such that the phase angle directly relates to an axial position of the spool.

9. The phaser of claim 8, further comprising a check valve in the supply line.

10. The phaser of claim 8, wherein the at least two edges are parallel to each other.

* * * * *